US005725998A

United States Patent [19]

Sanpei

[11] Patent Number: 5,725,998

[45] Date of Patent: Mar. 10, 1998

[54] PROCESS FOR DEVELOPING BLACK-AND-WHITE SILVER HALIDE PHOTOGRAPHIC LIGHT-SENSITIVE MATERIALS CONTAINING A HYDRAZINE COMPOUND AND A NUCLEATION COMPOUND, IN A DEVELOPER CONTAINING A DEVELOPING AGENT AND A MERCAPTO COMPOUND

[75] Inventor: Takeshi Sanpei, Hino, Japan

[73] Assignee: Konica Corporation, Japan

[21] Appl. No.: 838,603

[22] Filed: Apr. 10, 1997

Related U.S. Application Data

[63] Continuation of Ser. No. 386,206, Feb. 9, 1995, abandoned, which is a continuation of Ser. No. 127,773, Sep. 27, 1993, abandoned.

[30] Foreign Application Priority Data

Oct. 12, 1992 [JP] Japan ..... 4-273007

[51] Int. Cl.[6] ..... G03C 5/18; G03C 5/26; G03C 1/06

[52] U.S. Cl. ..... 430/399; 430/264; 430/438; 430/439; 430/440; 430/448; 430/488; 430/489; 430/491

[58] Field of Search ..... 430/264, 399, 430/438, 439, 440, 448, 487, 488, 489, 491, 957

[56] References Cited

U.S. PATENT DOCUMENTS

| | | | |
|---|---|---|---|
| 3,447,925 | 6/1969 | Dersch et al. | 430/434 |
| 4,668,605 | 5/1987 | Okutsu et al. | 430/489 |
| 4,914,003 | 4/1990 | Yagihara et al. | 430/448 |
| 4,929,535 | 5/1990 | Takahashi et al. | 430/448 |
| 4,965,169 | 10/1990 | Hirano et al. | 430/438 |
| 5,158,856 | 10/1992 | Uswagawa et al. | 430/264 |
| 5,210,002 | 5/1993 | Adin | 430/264 |
| 5,213,944 | 5/1993 | Adin | 430/264 |
| 5,229,248 | 7/1993 | Sanpei et al. | 430/264 |
| 5,244,773 | 9/1993 | Muramatsu et al. | 430/264 |
| 5,534,389 | 7/1996 | Arai et al. | 430/439 |

FOREIGN PATENT DOCUMENTS

| | | | |
|---|---|---|---|
| 473342 | 3/1992 | European Pat. Off. . | |
| 2403645 | 8/1974 | Germany | 430/438 |
| 45-6628 | 3/1970 | Japan | 430/438 |
| 3132649 | 6/1991 | Japan | 430/488 |
| 4029233 | 1/1992 | Japan | 430/440 |
| 4-98239 | 3/1992 | Japan . | |
| 940169 | 10/1963 | United Kingdom | 430/489 |

*Primary Examiner*—Glenn Caldarola
*Assistant Examiner*—J. Pasterczyk
*Attorney, Agent, or Firm*—Jordan B. Bierman; Bierman, Muserlian and Lucas

[57] ABSTRACT

A method of developing an exposed black and white silver halide photographic light-sensitive material with developer using an automatic processor is disclosed, the developing comprising supplying replenisher for developer in an amount of not more than 200 ml per $m^2$ of the material, the material containing a hydrazine derivative and an infectious development nucleation agent, and the developer having a pH value of 10.0 to 11.2 and containing a dihydroxy benzene compound, a 3-pyrazolidone compound or an aminophenol compound, a sulfite of 0.3 to 1.2 mol/liter and at least one of compounds represented by the following formulae (1) and (2):

$$Z-SM \qquad \text{Formula (1)}$$

$$\begin{array}{l}(S)_n-A_1(-B_1)_{m_1}\\ \quad\;\;|\\ \quad\;\;S-A_2(-B_2)_{m_2}\end{array} \qquad \text{Formula (2)}$$

17 Claims, No Drawings

PROCESS FOR DEVELOPING BLACK-AND-WHITE SILVER HALIDE PHOTOGRAPHIC LIGHT-SENSITIVE MATERIALS CONTAINING A HYDRAZINE COMPOUND AND A NUCLEATION COMPOUND, IN A DEVELOPER CONTAINING A DEVELOPING AGENT AND A MERCAPTO COMPOUND

This application is a continuation of application Ser. No. 08/386,206, filed Feb. 9, 1995, now abandoned, which application is a continuation of application Ser. No. 08/127,773, filed Sep. 27, 1993, now abandoned.

FIELD OF THE INVENTION

This invention relates to a process for developing a black-and-white silver halide photographic light-sensitive material comprising a support bearing silver halide light-sensitive layers and, particularly to a process for developing a black-and-white silver halide photographic light-sensitive material, in which a high contrast can be provided without spoiling sensitivity, and any black-spot and silver sludge production can be prevented.

BACKGROUND OF THE INVENTION

The photolithographic process includes a step for converting a continuous tone original into a halftone dot image. In this step, an infectious development technique has been used as a photographic technique capable of reproducing ultra-hard contrast images.

The lithographic type silver halide photographic light-sensitive materials applicable to the infectious development are comprised of, for example, a silver chlorobromide emulsion of which the grains have an average grain size of 0.2 μm, a narrow grain distribution, a uniform configuration and a high silver chloride content (not less than 50 mol %). When the above-mentioned lithographic type silver halide photographic light-sensitive material is processed with an alkaline hydroquinone developer having a low sulfite ion concentration, that is so-called a lithographic type developer, an image having a high contrast, high sharpness and high resolving power can be provided.

However, the lithographic type developer has a very low preservability, because it is affected by air oxidation. Therefore, a constant development quality can not be maintained when the developer is used continuously.

There have been well-known processes for providing a high contrast image rapidly without making use of the above-mentioned lithographic type developer. As is found in Japanese Patent Publication Open to Public Inspection (hereinafter referred to as JP OPI Publication) No. 56-106244/1981, for example, a hydrazine derivative is contained in a silver halide photographic light-sensitive material and the light-sensitive material is processed with an alkali developer containing an amino compound. According to these processes, an image having an excellent preservability and a high contrast can be provided even when the light-sensitive material is processed with a rapid processing developer.

In the above-mentioned techniques, the light-sensitive material has been processed inevitably with a developer having a pH exceeding 11.2, so that the contrast hardening property of the hydrazine derivative can satisfactorily be displayed. The developing agent of the above-mentioned developer having a pH exceeding 11.2 are liable to be oxidized when the developer is exposed to the air. When the developing agent is exposed to the air, there may be some instances where an ultra-hard contrast image may not be available, though the above-mentioned developer is relatively more stable than the lithographic type developers.

For remedying the above-mentioned defects, JP OPI Publication No. 63-29751/1988 and European Patent Nos. 333,435 and 345,025 disclose the silver halide photographic light-sensitive materials containing a contrast hardener capable of hardening the contrast of the light-sensitive materials, even when a relatively low pH developer is used. According to the above-mentioned processes, the resistance against the air oxidation of the developers can be improved remarkably as compared to the cases of the lithographic type developers. However, for further increasing the stability, it is required to add a sulfite in an amount of not less than 0.3 mols per liter of the developer to be used.

On the other hand, generally, lithographic black-and-white silver halide photographic light-sensitive materials are exposed to light and then processed through an automatic processor. In this case, it is also usual that they are so processed as to obtain stable photographic characteristics by replenishing a developer in a specific amount in proportion to the area of the light-sensitive material to be processed. For obtaining such a hard contrast image as mentioned above, the processes have been carried out while, replenishing a developer replenisher in an amount of not less than 300 ml per liter of the developer used, so that the fatigue of the processing solutions produced in a continuous processing operation and the deterioration of developer produced by an air oxidation can be prevented.

However, with the recent increase in the concern for the environmental protection, it is of urgent importance to reduce the amount of waste developer. When hard contrast light-sensitive materials such as those mentioned above are continuously processed under the conditions that a developer is replenished in an amount of not more than 200 ml per $m^2$ of the light-sensitive material, the sulfite concentration of the developer becomes high as mentioned above and when an automatic processor is used, a silver stain, that is so-called a silver sludge, is liable to be produced. In the silver stain, silver is dissolved out of a light-sensitive material into a developer and a black or silver extraneous deposit adheres to the various positions of an automatic processor, such as the rollers and gears thereof, resulting in contamination or damage to the surface of the light-sensitive material which spoils the finished characteristics of the light-sensitive material. For the development processes of hard contrast light-sensitive materials for lithographic printing use, it is, therefore, essential to eliminate the above-mentioned silver sludges.

When a development process is carried out by making use of an automatic processor, it usually takes not shorter than 90 seconds from the time the leading edge of a film is inserted into the automatic processor to the point when the leading edge of the film gets out of a drying zone, (the whole time is called a Dry to Dry time). In recent years, however, it has been demanded to shorten a development processing time due to the increase in the numbers of printing matters and the saving of working hours. Therefore, when a hard contrast light-sensitive material containing a hydrazine derivative is rapidly processed in the processing time (dry to dry) within 60 seconds with an automatic processor under the conditions such as those mentioned before, there have been such a trouble that a silver contamination is liable to be more deteriorated and, at the same time, the development process is liable to be unstable, and a sand-shaped fog that is so-called black spot peculiarly produced in a hydrazine derivative-containing light-sensitive material is liable to be produced in unexposed portions after completing the development process.

Well-known silver sludge preventives against silver contamination, which may generally be added to developers include, for example, a 2-mercapto-1,3,4-thiadiazole (such as those given in British Patent No. 940,169), a 2-mercapto-1,3,4-thiadiazole or a 1-phenyl-5-mercapto-tetrazole (such as those given in U.S. Pat. No. 3,173,789), and 2-mercaptobenzoxazole and 2-mercaptobenzimidazole (each given in Photogr. Sci. Eng., 20, p.220, 1976). However, when processing is carried out with an alkali developer containing a hydrazine derivative and an amino compound and also with such a silver sludge preventative as mentioned above, there have been such a problem that not only the silver sludge preventing effect is not satisfactory, but sensitivity is lowered, contrast is softened and black spot prevention effect is poor.

SUMMARY OF THE INVENTION

It is an object of the invention to provide a process for developing a black-and-white silver halide photographic light-sensitive material, in which ultrahard contrast photographic characteristics can be obtained without decreasing sensitivity and which, at the same time, can prevent silver sludge and black spot production.

The above-mentioned object of the invention can be achieved in a process for developing with developer a black-and-white silver halide photographic light-sensitive material comprising a support and provided thereon, a silver halide photographic emulsion layer and/or a hydrophilic colloid layer other than the silver halide photographic emulsion layer using an automatic processor, replenisher for developer being supplied to the developer in an amount of not more than 200 ml per $m^2$ of the material, at least one layer of the emulsion layer and the hydrophilic colloid layer containing a hydrazine derivative, and the developer having a pH value of 10.0 to 11.2 and comprising the following compounds (1) through (4):

(1) a dihydroxy benzene type developing agent, (2) a 3-pyrazolidone type or aminophenol type developing agent, (3) 0.3 to 1.2 mol/liter of a sulfite, and (4) at least one of compounds represented by the following Formulae (1) and (2):

Formula V-III

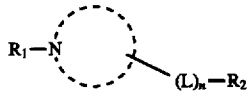

wherein Z represents an alkyl, aryl or heterocyclic group having a group selected from a hydroxy group, a $—SO_3M^1$ group, a $—COOM^1$ group, a substituted or unsubstituted amino group and a substituted or unsubstituted ammonio group (wherein $M^1$ represents a hydrogen atom, an alkali metal atom or a substituted or unsubstituted ammonium ion) or a substituent having the group; and M represents a hydrogen atom, an alkali metal atom or a substituted or unsubstituted amidino group which may form a hydrogen halogenide or sulfonate salt.

Formula V-III

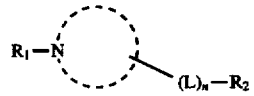

wherein $A_1$ and $A_2$ independently represent an aliphatic group, an alicyclic group, an aralkyl group, an aryl group, or a 5 or a 6-membered heterocyclic group having hydrogen atom or a substituent; $m_1$ and $m_2$ each represent 1, 2 or 3; n represents 1 or 2; and $B_1$ and $B_2$ independently represent —COOM, $—SO_3M'$, —CON(X)(Y), —S—Z' or $—SO_2N(X)(Y)$ wherein X and Y independently represent a hydrogen atom, an alkyl group having 1 to 8 carbon atoms or an aryl group, either of which may have a hydroxy group, a carboxylic acid group or a sulfonic acid group; M' represents a monovalent cation; and Z' is synonymous with X and Y, provided that Z' is not a hydrogen atom.

It is also preferred that the total processing time is within the range of 20 to 60 seconds, when making use of an automatic processor.

Now, the invention will concretely be detailed below.

The dihydroxybenzene type developing agents applicable to the developer of the invention include, for example, hydroquinone, chlorohydroquinone and methyl hydroquinone. Among them, hydroquinone is preferably used.

The examples of the 3-pyrazolidone type developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The aminophenol type developing agents include, preferably, N-methyl-p-aminophenol, p-aminophenol, N-(β-hydroxyethyl)-p-aminophenol, N-(4-hydroxyphenyl) glycine, 2-methyl-p-aminophenol, p-benzylaminophenol and so forth. Among them, N-methyl-p-aminophenol is preferably used.

It is preferred that dihydroxybenzene type developing agents are ordinarily used in an amount within the range of 0.05 mols/liter to 2 mols/liter. A 3-pyrazolidone or an aminophenol is preferably used in an amount of 0.0001 to 1 mol/liter. A dihydroxybenzene is more preferably used in an amount within the range of 0.05 to 1.5 mols/liter. A 3-pyrazolidone or an aminophenol is more preferably used in an amount of 0.0001 to 0.2 mols/liter.

The sulfite preservatives applicable to the invention include, for example, sodium sulfite, potassium sulfite, lithium sulfite, sodium bisulfite, potassium metabisulfite, and sodium formaldehyde bisulfite. The sulfites are ordinarily used in an amount of not less than 0.3 mols/liter. If they are added too much, they precipitate in a developer so that the developer is contaminated. It is, therefore, advisable to use them in an amount of 1.2 mols/liter as the upper limit.

In the invention, the pH value of the developer are to be within the range of 10.0 to 11.2. If the pH is lower than 10, no hard contrast image can be obtained. If the pH exceeds 11.2, fogginess is liable to increase. The pH value is preferably 10.0 to 10.9, and more preferably 10.0 to 10.7.

Now, the compounds represented by Formula (1) will be detailed below.

In the Formula, Z represents an alkyl, aryl or heterocyclic group having a group selected from a hydroxy group, a $—SO_3M^1$ group, a $—COOM^1$ group, a substituted or unsubstituted amino group and a substituted or unsubstituted ammonio group (wherein $M^1$ represents a hydrogen atom, an alkali metal atom or a substituted or unsubstituted ammonium ion) or a substituent having the group; and M represents a hydrogen atom, an alkali metal atom or a substituted or unsubstituted amidino group which may form a hydrogen halogenide or sulfonate salt.

The expression in the above, 'a substituent having the group', means a substituent having not more than 20 carbon atoms. These substituents include, for example, a substituted or unsubstituted alkylthio group, a substituted or unsubstituted alkylamido group, a substituted or unsubstituted alkylcarbamoyl group, a substituted or unsubstituted alkylsulfonamido group and a substituted atoms and, particularly, a straight-chained, branched or cyclic alkyl group having 2 to 20 carbon atoms, provided that the alkyl groups may also have other substituents than the above-given substituents. The aromatic groups represented by Z are preferably those of the monocyclic or condensed ring type having each 6 to 32 carbon atoms, provided that they may also have other substituents than the above-given substituents. The heterocyclic groups represented by Z include, preferably, those of the monocyclic or condensed ring type having each 1 to 32 carbon atoms, and they have each 5- or 6-membered ring and 1 to 6 hetero atoms selected independently from the group consisting of nitrogen, oxygen and sulfur atoms, provided that they may also have other substituents than the above-given substituents.

In Formula (1), the ammonio group has as a substituent a substituted or unsubstituted straight-chained, branched or cyclic alkyl group (such as a methyl, ethyl, benzyl, ethoxypropyl or cyclohexyl group), a substituted or unsubstituted phenyl group or naphthyl group and the substituent has preferably 20 or less carbon atoms.

Among the compounds represented by Formula (1), the particularly preferable include, for example, those represented by the following Formulas (1-a), (1-b) and (1-c).

These compounds are described in JP OPI Publication Nos. 56-72441/1981, 56-24347/1981, 60-122642/1985, 60-258537/1985 and 4-29233/1992. However, there is no disclosure of the effects obtainable when a light-sensitive material containing a hydrazine derivative is developed with such a developer to which these compounds are added, and the developer is replenished in a replenishing amount of not more than 200 ml/liter.

Formula (1-a)

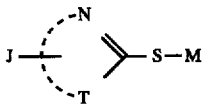

wherein T represents an atomic group necessary to form a 5-membered heterocyclic ring; J represents a hydroxy group, $—SO_3M^1$, $—COOM^1$ (in which $M^1$ is synonymous with $M^1$ denoted in Formula (1)), a substituted or unsubstituted amino group or a substituted or unsubstituted ammonio group, or an alkylthio group having 1 to 19 carbon atoms, an alkylamido group having 2 to 18 carbon atoms, an alkylcarbamoyl group having 2 to 18 carbon atoms, an alkyl group having 1 to 19 carbon atoms or an aromatic group having 6 to 31 carbon atoms, each substituted with one or more of the above-given groups; and M is synonymous with M denoted in Formula (1).

Formula (1-b)

$A^1$—ALK—$SM^2$ wherein $A^1$ represents a hydroxy group, $—SO_3M^1$, $—COOM^1$ (in which $M^1$ is synonymous with $M^1$ denoted in Formula (1)), a $—N(R^3)_2$ group (in which $R^3$ represents a substituted or unsubstituted alkyl group having 1 to 5 carbon atoms, provided that a ring may be formed by linking to each other); ALK represents a substituted or unsubstituted alkylene group having 2 to 12 carbon atoms; and $M^2$ represents a hydrogen atom or the following group.

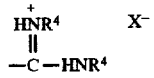

wherein $R^4$ represents a hydrogen atom, a substituted or unsubstituted alkyl group having 1 to 5 carbon atoms, or a substituted or unsubstituted phenyl group having not more than 10 carbon atoms; $X^-$ represents a halide ion or sulfonic acid ion, or a —S—ALK—$A^1$ group.

Formula (1-c)

$A^1$—Ar—SM wherein $A^1$ is synonymous with $A^1$ denoted in Formula (1-b); Ar represents an aryl group that may be substituted; and M is synonymous with M denoted in Formula (1).

Now, the typical examples of the compounds represented by Formula (1) will be given below. It is, however, to be understood that the invention shall not be limited thereto.

(1-1)

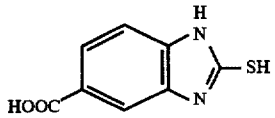

(1-2)

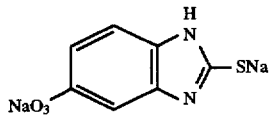

(1-3)

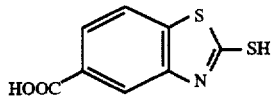

(1-4)

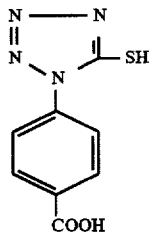

(1-5)

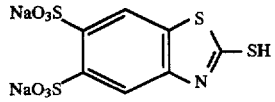

(1-6)

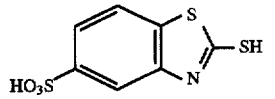

(1-7)

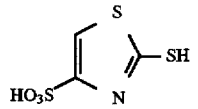

(1-8)

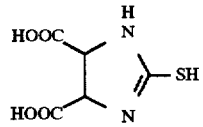

-continued
(1-9)
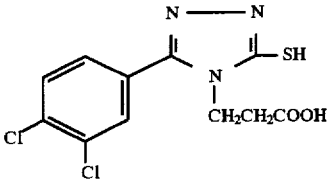
(1-10)
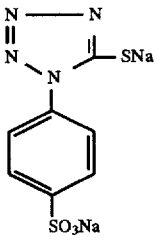
(1-11)
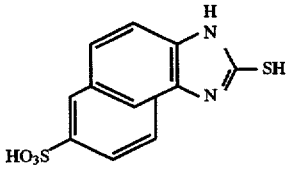
(1-12)
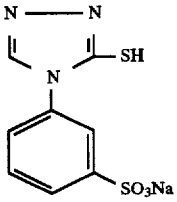
(1-13)
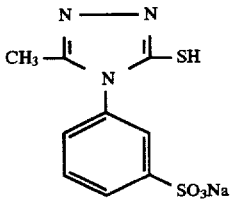
(1-14)
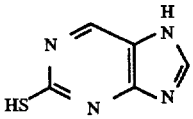
(1-15)
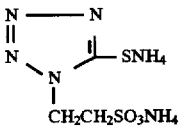
(1-16)
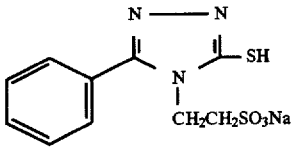
-continued
(1-17)
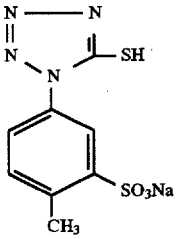
(1-18)
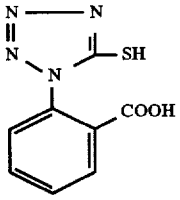
(1-19)
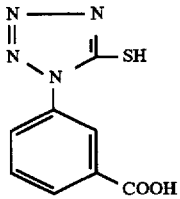
(1-20)
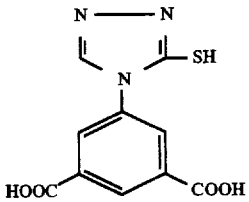
$HS-CH_2-CH_2-COOH$ (1-21)
$NaS-CH_2-CH_2-SO_3Na$ (1-22)
(1-23)
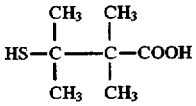
(1-24)
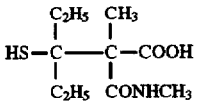
91-25)
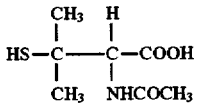
(1-26)
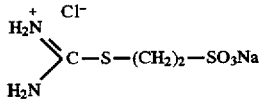
(1-27)
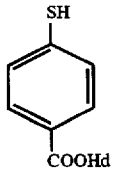

-continued (1-28)

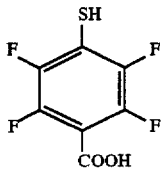

(1-29)

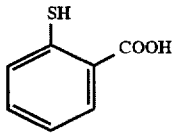

(1-30)

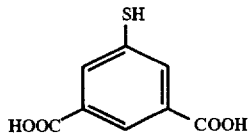

(1-31)

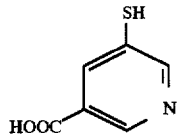

(1-32)

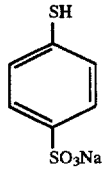

Now, Formula (2) will be detailed below.

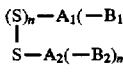

Formula (2)

wherein $A_1$ and $A_2$ independently represent an aliphatic group, an alicyclic group, an aralkyl group, an aryl group, or a 5 or 6-membered heterocyclic group having hydrogen atom or a substituent; $m_1$ and $m_2$ each represent 1, 2 or 3; n represents 1 or 2; and $B_1$ and $B_2$ independently represent —COOM, —$SO_3M'$, —CON (X) (Y) , —S—Z' or —$SO_2N$ (X) (Y) wherein X and Y independently represent a hydrogen atom, an alkyl group having 1 to 8 carbon atoms or an aryl group, either of which may have a hydroxy group, a carboxylic acid group or a sulfonic acid group; M' represents a monovalent cation; and Z' is synonymous with X and Y, provided that Z' is not a hydrogen atom.

Among the compounds represented by Formula (2), the preferable compounds may be represented by the following Formulas (2-a) and (2-b).

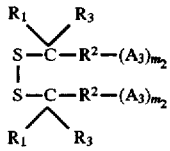

Formula (2-a)

-continued

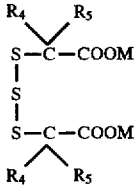

Formula (2-b)

In Formula (2-a), $R_1$ and $R_3$ represent each a hydrogen atom, an alkyl group having 1 to 6 carbon atoms that may be substituted, an alkenyl group, an aralkyl group, a cycloalkyl group, a phenyl group that may be substituted, a 5- or 6-membered heterocyclic ring each containing 1 to 3 nitrogen atoms, an oxygen atom or a sulfur atom, or a carboxylic acid group; $R_2$ represents a direct bond, an alkylene group that may be substituted, an alkylidene group, a phenylene group, an aralkylene group or —$CONHCH_2$—; $A_3$ represents —COOM or —$SO_3M$ (in which M is synonymous with $M^1$ denoted in Formula (1)); and $m_2$ is an integer of 1 or 2.)

In Formula (2-b), $R_4$ and $R_5$ represent each a hydrogen atom or a methyl group; and M preferably represents a hydrogen cation or an alkali-metal ion (such as $Na^+$ or $K^+$).

Among the compounds represented by Formula (2-a), the compounds represented by Formula (2-a-1) are preferable.

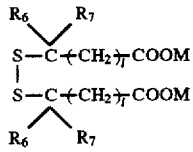

Formula (2-a-1)

In Formula (2-a-1), $R_6$ and $R_7$ represent each a hydrogen atom, an alkyl group that may be substituted (such as —$CH_3$, —$C_2H_5$, —$CH_2OH$, and —$CH_2COOH$), a cycloalkyl group (such as a cyclopentyl group and a cyclohexyl group), a phenyl group that may be substituted (such as a phenyl group, a tolyl group, a p-chlorophenyl group, an aminophenyl group, a p-sulfophenyl group and a p-sulfonamidophenyl group), a 5- or 6-membered heterocyclic ring containing 1 to 3 nitrogen atoms, an oxygen atom or a sulfur atom (such as a furyl group and a thienyl group), or a carboxylic acid group, provided, $R_6$ and $R_7$ may be the same with or the different from each other; and l is an integer of 1, 2, 3 or 4.

These compounds are disclosed in JP OPI Publication No. 4-29233/1992. However, the effects of the developers for light-sensitive materials containing a hydrazine derivative as a contrast hardener have not yet been disclosed.

Now, the typical examples of the compounds represented by Formula (2) will be given below.

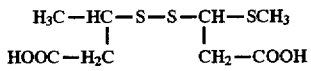

(2-1)

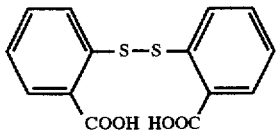

(2-2)

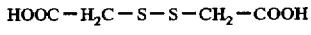

(2-3)

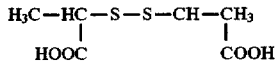

(2-4)

-continued

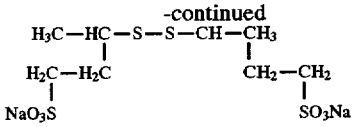
(2-5)

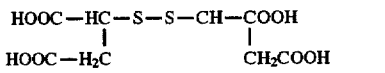
(2-6)

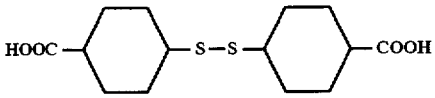
(2-7)

Thiolactic acid
α-mercaptoisobutyric acid (2-8)

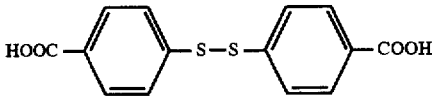
(2-9)

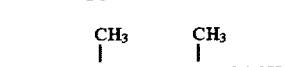
(2-10)

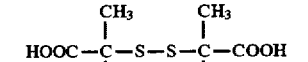
(2-11)

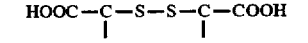
(2-12)

(2-13)

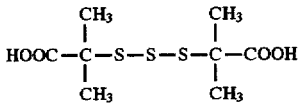
(2-14)

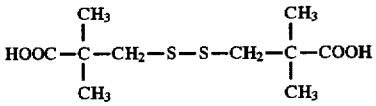
(2-15)

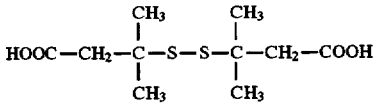
(2-16)

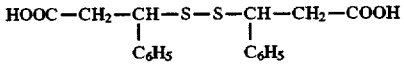
(2-17)

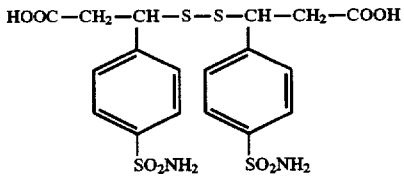
(2-18)

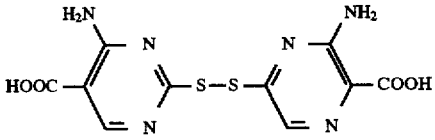
(2-19)

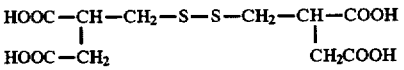
(2-20)

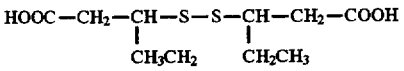
(2-21)

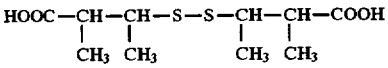
(2-22)

-continued

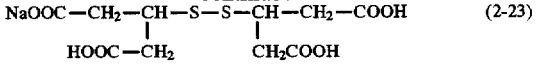
(2-23)

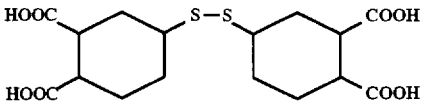
(2-24)

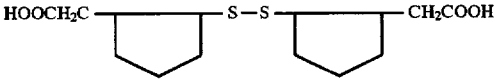
(2-25)

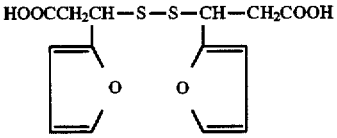
(2-26)

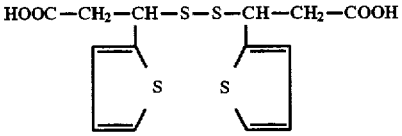
(2-27)

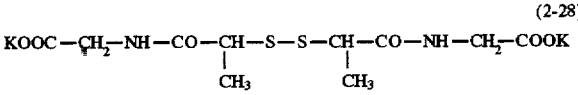
(2-28)

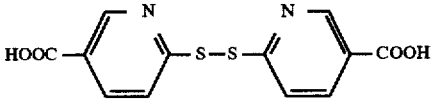
(2-29)

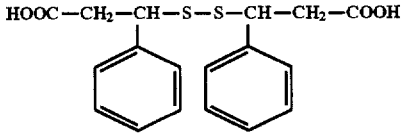
(2-30)

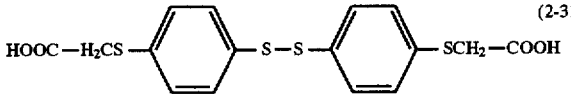
(2-31)

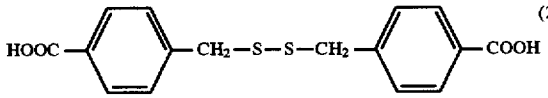
(2-32)

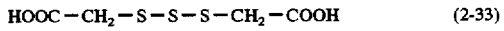
(2-33)

The compounds represented by Formula (1) or (2) of the invention may be used preferably in an amount within the range of 0.1 millimols to 10 millimols per liter of developer used.

The black-and-white silver halide photographic light-sensitive materials of the invention are processed through an automatic processor. In processing them, they are processed while replenishing a developer in a specific amount in proportion to the area of the light-sensitive material processed. The amount of the developer to be replenished is to be not more than 200 ml and, preferably, within the range of not less than 75 ml to not more than 200 ml per $m^2$ of the light-sensitive material so that waste developer can be reduced. If the amount of the developer replenished is less than 75 ml, any satisfactory photographic characteristics cannot be obtained, due to the desensitization, softened contrast and so forth.

In view of shortening developing time, when a film is processed through an automatic processor, the whole processing time (a dry to dry time) is preferably within the range of 20 to 60 seconds from the time when the leading edge of the film is inserted into the automatic processor to the time when the leading edge thereof is delivered out of the drying zone of the automatic processor. The expression, 'the whole processing time' stated herein include the time for completing the whole processing step required for processing a black-and-white silver halide photographic light-sensitive material, such as, typically, the time required for completing the steps of developing, fixing, bleaching, washing, stabilizing, drying and so forth, that is so-called a dry to dry time. If the whole processing time is shorter than 20 seconds, any satisfactory photographic characteristics cannot be obtained, due to the desensitization, softened contrast and so forth. It is further preferable that the whole processing time (a dry to dry time) is within the range of 30 to 60 seconds.

The hydrazine derivatives applicable to the invention include, preferably, the compounds represented by the following Formula (H).

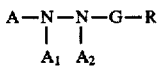

Formula (H)

wherein A represents an aryl group or a heterocyclic group containing at least one sulfur or oxygen atom; G represents a

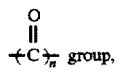

a sulfonyl group, a sulfoxy group, a

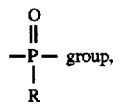

or an iminomethylene group; n is an integer of 1 or 2; $A_1$ and $A_2$ represent each a hydrogen atom, or one of them represents a hydrogen atom and the other represents a substituted or non-substituted alkylsulfonyl or acyl group; R represents a hydrogen atom or an alkyl, aryl, alkoxy, aryloxy, amino, carbamoyl, oxycarbonyl or —O—$R_2$ group in which $R_2$ represents an alkyl or saturated heterocyclic group.

Among these compounds, the compounds represented by the following Formula (H-c) or (H-d) are further preferable in the invention.

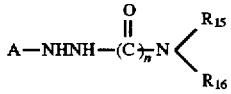

Formula (H-c)

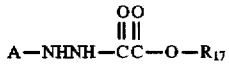

Formula (H-d)

wherein A represents an aryl group or a heterocyclic group containing at least one sulfur or oxygen atom; n is an integer of 1 or 2 and, when n is 1, $R_{15}$ and $R_{16}$ represent each a hydrogen atom, an alkyl, alkenyl, alkinyl, aryl, heterocyclic, hydroxy, alkoxy, alkenyloxy, alkinyloxy, aryloxy or heterocyclic-oxy group, provided, $R_{15}$ and $R_{16}$ may form a ring together with a nitrogen atom and, when n is 2, $R_{15}$ and $R_{16}$ represent each a hydrogen atom, an alkyl, alkenyl, alkinyl, aryl, saturated or unsaturated heterocyclic, hydroxy, alkoxy, alkenyloxy, alkinyloxy, aryloxy or heterocyclic-oxy group, provided when n is 2, at least one of $R_{15}$ and $R_{16}$ represents an alkenyl, alkinyl, saturated heterocyclic, hydroxy, alkoxy, alkenyloxy, alkinyloxy, aryloxy or heterocyclic-oxy group; and $R_{17}$ represents an alkyl, alkenyl, aryl, alkinyl or heterocyclic group.

The compounds represented by Formula (H-c) or (H-d) include the compounds in which at least one of the two Hs denoted in —NHNH— of the Formula is substituted by a substituent.

To be further detailed, A represents an aryl group (such as a phenyl or naphthyl group), or a heterocyclic group containing at least one of sulfur or oxygen atoms (such as a thiophene, furan, benzothiophene or pyrane group).

$R_{15}$ and $R_{16}$ represent each a hydrogen atom, an alkyl group (including, for example, a methyl, ethyl, methoxyethyl, cyanoethyl, hydroxyethyl, benzyl or trifluoroethyl group), an alkenyl group (including, for example, an allyl, butenyl, pentenyl or pentadienyl group), an alkinyl group (including, for example, a propargyl, butynyl or pentenyl group), an aryl group (including, for example, a phenyl, naphthyl, cyanophenyl or methoxyphenyl group), a heterocyclic group (including, for example, an unsaturated heterocyclic group such as a pyridine, thiophene or furan group and a saturated heterocyclic group such as a tetrahydrofuran or sulfolane group), a hydroxy group, an alkoxy group (including, for example, a methoxy, ethoxy, benzyloxy or cyanomethoxy group), an alkenyloxy group (including, for example, an allyloxy or butenyloxy group), an alkinyloxy group (including, for example, a propargyloxy or butynyloxy group), an aryloxy group (including, for example, a phenoxy or naphthyloxy group), or a heterocyclic-oxy group (including, for example, a pyridyloxy or pyrimidyloxy group); provided when n is 1, $R_{15}$ and $R_{16}$ may form a ring (such as a piperidine, piperazine or morpholine ring) together with a nitrogen atom.

Provided when n is 2, at least one of $R_{15}$ and $R_{16}$ represents an alkenyl, alkinyl, saturated heterocyclic, hydroxy, alkoxy, alkenyloxy, alkinyloxy, aryloxy or heterocyclic-oxy group.

The typical example of the alkyl, alkenyl, aryl, alkinyl groups or heterocyclic group each represented by $R_{17}$ includes those given above.

Into the aryl group, or the heterocyclic group having at least one sulfur or oxygen atom, represented by A, a variety of substituents may be introduced. The substituents which can be introduced thereinto include, for example, a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamido group, an aryl aminothiocarbonylamino group, a hydroxy group, a carboxy group, a sulfo group, a nitro group and a cyano group. Among these substituents, a sulfonamido group is preferable.

In each of the formulas, A is preferable to contain at least one of antidiffusible groups or silver halide adsorption accelerating groups. The antidiffusible groups include, preferably, a ballast group commonly applicable to immobile photographic additives such as couplers. The ballast groups are relatively inert groups having not less than 8 carbon atoms, and they may be selected, for example, from the group consisting of an alkyl group, a phenyl group, an alkylphenyl group, a phenoxy group, an alkylphenoxy group and so forth.

The silver halide adsorption accelerating groups include, for example, those given in U.S. Pat. No. 4,385,108, such as a thiourea group, a thiourethane group, a heterocyclic thioamido group, a mercaptoheterocyclic group and a triazole group.

H of the —NHNH— of Formulas (H-c) and (H-d), that is, a hydrogen atom contained in hydrazine, may also be substituted with substituents including, for example, a sulfonyl group (such as a methanesulfonyl or toluenesulfonyl group), an acyl group (such as an acetyl, trifluoroacetyl or ethoxycarbonyl group), and an oxalyl group (such as an ethoxalyl or pyruvoyl group). The compounds represented by Formulas (H-c) and (H-d) include such compounds as mentioned above.

In the invention, further preferable compounds include, for example, those given in the case where n is 2 in Formula (H-c).

In the compounds given in the case where n is 2 in Formula (H-c), it is further preferable when $R_{15}$ and $R_{16}$ represent each a hydrogen atom, an alkyl group, an alkenyl group, an alkinyl group, an aryl group, a saturated or unsaturated heterocyclic group, a hydroxy group or an alkoxy group, and at least one of $R_{31}$ and $R_{32}$ represents an alkenyl group, an alkinyl group, a saturated heterocyclic group, a hydroxy group or an alkoxy group.

The typical compounds represented by the foregoing Formulas (H-c) and (H-d) include the following compounds. However, it is the matter of course that the concrete compounds represented by (H-c) and (H-d) which are applicable to the invention shall not be limited thereto.

Examples of the concrete compounds are shown below.

c-1

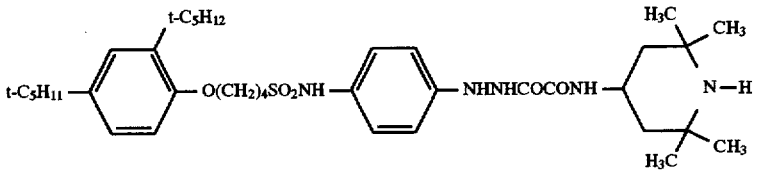

c-2

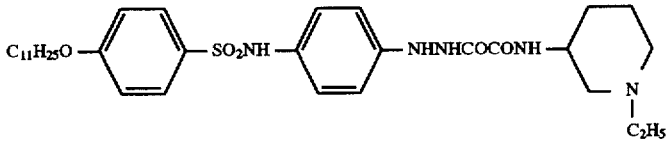

c-3

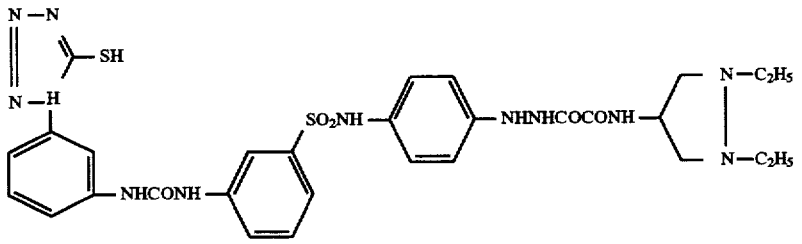

d-1

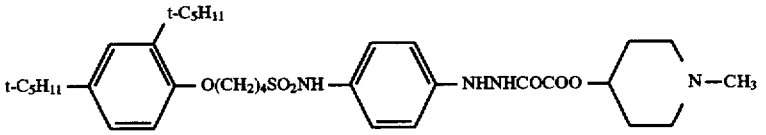

c-4

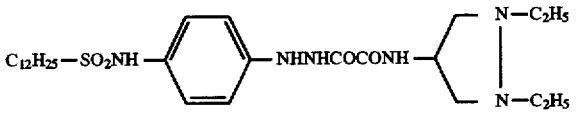

c-5

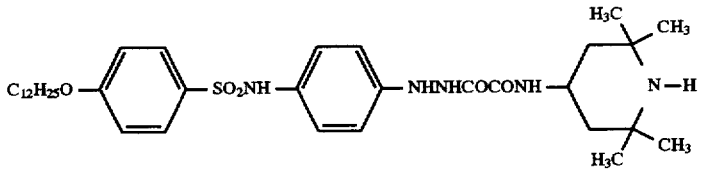

d-2

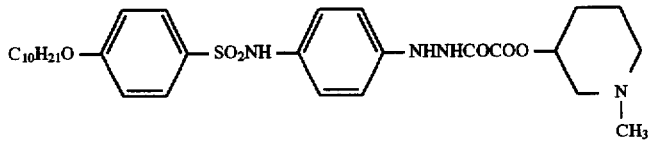

-continued c-6

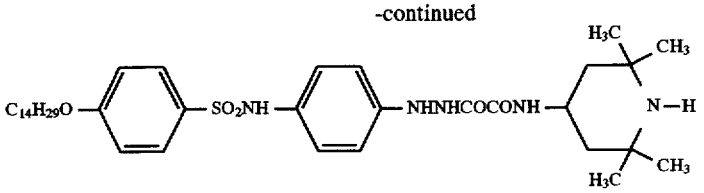

d-3

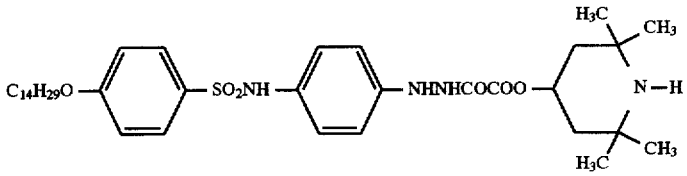

c-7

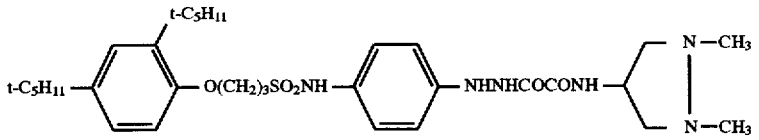

d-4

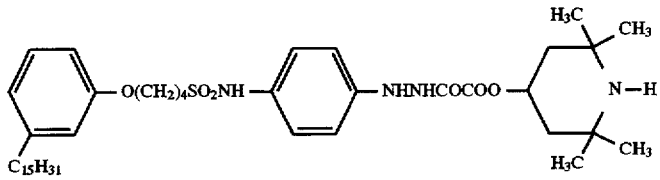

c-8

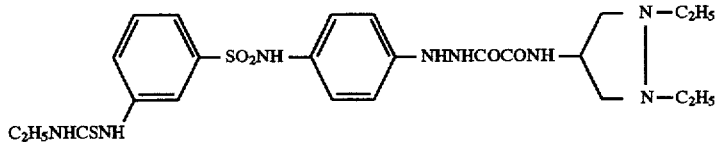

d-5

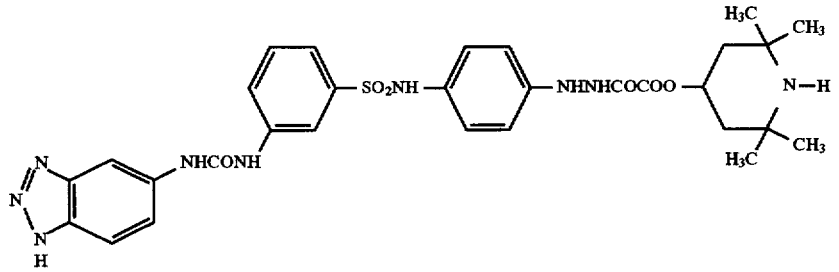

The other concrete compounds than the above include, for example, the examples of the compounds (1) through (61) and (65) through (75) each given in JP OPI Publication No. 2-841/1990, pp.542(4)~546(8).

The hydrazine derivatives of the invention may be synthesized in the process described in JP OPI Publication No.2-841/1990, pp.546(8)~550(12).

The hydrazine derivatives of the invention are added to silver halide emulsion layers and/or the layers adjacent thereto. These derivatives are to be added in an amount within the range of, preferably, $1\times10^{-6}$ mols to $1\times10^{-1}$ mols and, particularly, $1\times10^{-5}$ mols to $1\times10^{31\ 2}$ mols per mol of silver.

When the hydrazine derivatives contain the compounds represented by Formula (H-c) or (H-d), it is preferable to contain at least one kind of the nucleation accelerating compounds described in JP OPI Publication No. 4-98239/1992, the 1st line of the upper left column on p.(7) through the 11th line of the lower left column of p.(26) into a silver halide emulsion layer and/or a non-light-sensitive layer arranged to the silver halide emulsion layer side of a support.

In the invention, amine compounds and quarternary onium salt compounds, which are nucleation promoting compounds and jointly applicable together with the compounds represented by Formula H, include for example, the compounds represented by the following formulas I through VI. Among them, the preferable compounds include for example the compounds represented by Formula V-I, V-II, V-III, VI-I, VI-II or VI-III. Represented by Formula V-I, V-II, VI-I or VI-II are more preferable and compounds of Formula VI-II are most preferable.

Formula I

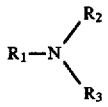

In Formula I, $R_1$, $R_2$ and $R_3$ represent each a hydrogen atom or a substituent, provided that $R_1$, $R_2$ and $R_3$ may combine each other to form a ring, and $R_1$, $R_2$ and $R_3$ are not hydrogen atoms at the same time. The substituents represented by $R_1$, $R_2$ and $R_3$ include, for example, an alkyl group such as a methyl, ethyl, propyl, butyl, hexyl or cyclohexyl group; an alkenyl group such as an allyl or butenyl group; an alkinyl group such as a propargyl or butynyl group; an aryl group such as a phenyl or naphthyl group; and a heterocyclic group such as a piperidinyl, piperazinyl, morpholinyl, pyridyl, furyl, thienyl, tetrahydrofuryl, tetrahydrothienyl or sulfolanyl group.

$R_1$, $R_2$ and $R_3$ may combine each other to form a ring such as piperidine, morpholine, piperazine, quinuclidine or pyridine.

The groups represented by $R_1$, $R_2$ and $R_3$ may have a substituent such as a hydroxy, alkoxy, aryloxy, carboxyl, sulfo, alkyl or aryl group.

$R_1$, $R_2$ and $R_3$ preferably represent each a hydrogen atom or an alkyl group;

Formula II

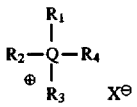

In Formula II, Q represents an N or P atom; $R_1$, $R_2$, $R_3$ and $R_4$ represent each a hydrogen atom or a substituent group; and $X^{\ominus}$ represent an anion, provided $R_1$, $R_2$, $R_3$ and $R_4$ may combine each other to form a ring.

The substituent groups represented by $R_1$, $R_2$, $R_3$ and $R_4$ include, for example, an alkyl, alkenyl, alkinyl, aryl, heterocyclic or amino group. They also include, typically, those groups represented by $R_1$, $R_2$ and $R_3$ denoted in Formula I. The ring which can be formed by $R_1$, $R_2$, $R_3$ and $R_4$ include, for example, the ring similar to the ring formed by $R_1$, $R_2$ and $R_3$ denoted in Formula I. The anions represented by $X^{\ominus}$ include, for example, inorganic and organic anions such as a halide ion, sulfate ion, nitrate ion, acetate ion, and paratoluene sulfonate ion;

Formula III

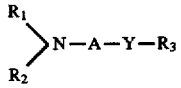

In Formula III, $R_1$ and $R_2$ represent each an alkyl group, provided that $R_1$ and $R_2$ may combine each other to form a ring; $R_3$ represents an alkyl, aryl or heterocyclic group; and A represents an alkylene group.

Y represents a $—CONR_4—$, $—OCONR_4$, $NR_4CONR_4$, $—NR_4COO—$, $—COO—$, $—OCO—$, $—CO—$, $—OCOO—$, $—NR_4CO—$, $—SO_2NR_4—$, $—NR_4SO_2—$, $—NR_4SO_2NR_4—$, $—SO_2—$, $—S—$, $—O—$, $—NR_1—$, or $—N=$ group wherein $R_4$ represents a hydrogen atom or an alkyl group.

The alkyl group represented by $R_1$ or $R_2$ includes, for example those similar to the alkyl group represented by $R_1$, $R_2$ and $R_3$ denoted in Formula I; and the ring formed in the above case include, for example, those similar thereto.

The alkyl, aryl and heterocyclic groups represented by $R_3$ also include, for example, those represented by $R_1$, $R_2$ and $R_3$ denoted in Formula I.

The alkylene group represented by A includes, for example, a methylene, ethylene, trimethylene or tetramethylene group; and the substituent for A includes, for example, an aryl, alkoxy or hydroxy group, or a halogen atom.

The alkyl group represented by $R_4$ includes, preferably, a lower alkyl group having 1 to 5 carbon atoms or an aralkyl group such as a benzyl group;

Formula IV

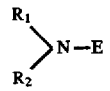

In Formula IV, $R_1$ and $R_2$ represent each a hydrogen atom, or an alkyl, alkenyl, alkinyl, aryl or heterocyclic group, provided that $R_1$, $R_2$ and E may form a ring.

E represents a group having at least one group represented by $—(—CH_2CH_2O—)_n—$ in which n is an integer of 2 or more.

The alkyl, alkenyl, alkinyl, aryl and heterocyclic group represented by $R_1$ and $R_2$ and the ring formed by $R_1$, $R_2$ and E include the same as $R_1$, $R_2$ and $R_3$ denoted in Formula I;

Formula V-I

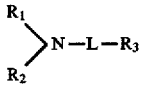

In Formula V-I, $R_1$, $R_2$ and $R_3$ represent each an alkyl, alkenyl, alkinyl, aryl or heterocyclic group, provided that at least one of $R_1$, $R_2$ and $R_3$ represents an alkenyl or alkinyl group, or at least one of $R_1$ and $R_2$ represents an aryl or heterocyclic group. $R_1$, $R_2$, $R_3$ and L may form a ring. L represents a linking group.

The alkyl, alkenyl, alkinyl, aryl and heterocyclic group represented each by $R_1$, $R_2$ and $R_3$ include the groups similar to those represented by $R_1$, $R_2$ and $R_3$ denoted in Formula I. The ring formed by $R_1$, $R_2$, $R_3$ and L includes, for example, a heterocyclic ring such as piperidine, morpholine or pyrrolidine.

The linking group represented by L includes, for example, —A—Y— given in Formula III;

Formula V-II

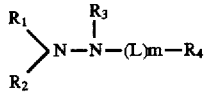

In Formula V-II, $R_1$, $R_2$ and $R_4$ represents an alkyl, alkenyl, alkinyl, aryl or heterocyclic group; and $R_3$ represents a hydrogen atom or a substituent.

L represents a linking group; and n is an integer of 0 or 1. $R_1$, $R_2$, $R_3$ and $R_4$ may combine each other to form a ring. The alkyl, alkenyl, alkinyl, aryl and heterocyclic group represented by $R_1$, $R_2$ and $R_4$ include, for example, the group similar to those detailed in $R_1$, $R_2$ and $R_3$ denoted in Formula I.

The substituent in the group represented by $R_3$ includes, for example, an alkyl, alkenyl, alkinyl, aryl and heterocyclic groups, and those similar to the above-mentioned may also be given.

L represents a linking group including, for example, $—CO—$, $—COO—$, $—CONR_5—$, $—SO_2—$ and $—SO_2NR_5—$ wherein $R_5$ represents a hydrogen atom or a substituent.

Formula V-III

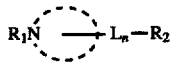

In Formula V-III, $R_1$ represents a hydrogen atom or a substituent; $R_2$ represents an alkyl, alkenyl, alkinyl, aryl or heterocyclic group;

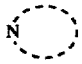

represents a nitrogen-containing hetero ring, provided that $R_1$ may form a ring together with

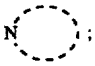

L represents a linking group; and n is an integer of 0 or 1.

The alkyl, alkenyl, alkinyl, aryl and heterocyclic group represented by $R_2$ includes the groups similar to those detailed in $R_1$, $R_2$ and $R_3$ denoted in Formula I.

The substituent among the groups represented by $R_1$ include, for example the groups similar to those detailed in the above-described $R_2$.

The heterocyclic ring represented by

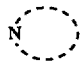

and the heterocyclic ring formed by

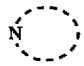

and $R_1$ include, for example, the heterocyclic ring such as quinuclidine, piperidine or pyrazolidine.

The linking group represented by L includes, for example, the groups similar to those represented by Y denoted in Formula III;

Formula VI-I

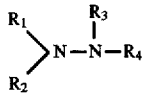

In Formula VI-I, $R_1$ and $R_2$ represent each an alkyl, alkenyl, alkinyl, aryl or heterocyclic group; and $R_3$ represents a hydrogen atom or a substituent.

$R_4$ represents a group containing at least one group represented by

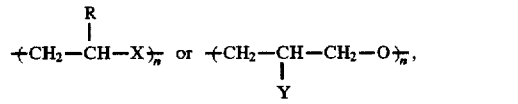

wherein R represents a hydrogen atom or an alkyl group, X represents an O, S or NH group, Y represents a hydrogen atom or an OH group, and n is an integer of not less than 2.

$R_1$, $R_2$, $R_3$ and $R_4$ may combine each other to form a ring. The alkyl, alkenyl, alkinyl, aryl or heterocyclic group represented by $R_1$ and $R_2$ includes, the group similar to those detailed in $R_1$, $R_2$ and $R_3$ denoted in Formula I.

The substituent represented by $R_3$ includes, for example, an alkyl, alkenyl, alkinyl, aryl, heterocyclic, acyl, sulfonyl, oxycarbonyl or carbamoyl group.

Among the substituent represented by $R_3$, the alkyl, alkenyl, alkinyl, aryl or heterocyclic group includes, for example, the group similar to those detailed in $R_1$, $R_2$ and $R_3$ denoted in Formula I.

The acyl group includes, for example, an acetyl or benzoyl group. The sulfonyl group includes, for example, a methanesulfonyl or toluene sulfonyl group. The oxycarbonyl group includes, for example, an ethoxycarbonyl or phenoxycarbonyl group. The carbamoyl group includes, for example, a methylcarbamoyl or phenylcarbamoyl group.

The ring formed by two of $R_1$, $R_2$, $R_3$ and $R_4$ includes, for example, a ring such as piperidine or morpholine.

Among the group represented by R, the alkyl group includes, for example, a methyl or ethyl group, and a methyl group may be preferable;

Formula VI-II

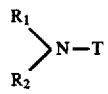

In Formula VI-II, $R_1$ and $R_2$ represent each a hydrogen atom or an alkyl, alkenyl, alkinyl, aryl or heterocyclic group; provided that $R_1$ and $R_2$ may form a ring. T represents a group containing at least one group represented by

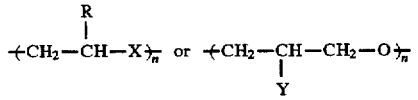

wherein R represents a hydrogen atom or an alkyl group, X represents an O, S or NH group, Y represents a hydrogen atom or an OH group, and n is an integer of not less than 2, provided that, when R represents a hydrogen atom, X represents a S or NH group. Among the group represented by $R_1$ or $R_2$, the alkyl, alkenyl, alkinyl, aryl or heterocyclic group includes, for example, the group similar to those detailed in $R_1$, $R_2$ and $R_3$ denoted in Formula I. The ring formed by $R_1$ and $R_2$ includes, for example, a heterocyclic ring such as piperidine, morpholine, quinuclidine or pyrazolidine. The alkyl group represented by R includes, for example, an methyl or ethyl group and, among them, a methyl groups are preferable;

Formula VI-III

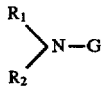

In Formula VI-III, $R_1$ and $R_2$ represent each a hydrogen atom or an alkyl, alkenyl, alkinyl, aryl or heterocyclic group, provided that $R_1$ and $R_2$ may form a ring.

G represents a group containing at least one group represented by $-(-CH_2CH_2O-)_n-$ and at least two substituents each having a hydrophobic substituent constant $\pi$ within the range of −0.5 to −1.0 or at least one substituent having a $\pi$ value smaller than −1.0. n is an integer of not less than 2. Among the group represented by $R_1$ or $R_2$, the alkyl, alkenyl, alkinyl, aryl or heterocyclic group includes, for example, the group similar to those detailed in $R_1$, $R_2$ and $R_3$ denoted in Formula I.

The ring formed by $R_1$ and $R_2$ includes, for example, a ring such as piperidine, quinuclidine or morpholine.

The above-mentioned hydrophobic substituent constant $\pi$ is detailed in "The Structural Activity Correlation of Chemical Substances", 1979, pp. 79–103, Nanko-Do Publishing Co.

The substituent having a $\pi$ value within the range of −0.5 to −1.0 includes, for example, the groups of —CN, —OH, $-OSO_2CH_3$, $-OCOCH_3$, $-SO_2N(CH_3)_2$, $-NHCOCH_3$, or —N O. The substituent having a $\pi$ value smaller than −1.0 include, for example, a group such as $-CONH_2$, —CONHOH, $-CONHCH_3$, $-NH_2$, $-NHCONH_2$, $-NHCSNH_2$, $-NHSO_2CH_3$, $-N^{\oplus}(CH_3)_3$, $-O^{\ominus}$, $-OCONH_2$, $-SO_3^{\ominus}$, $-SO_2NH_2$, $-SOCH_3$, $-SO_2CH_3$, or $-COO^{\ominus}$.

In the silver halide photographic light sensitive material of the invention capable of obtaining a high contrast image, at least one kind of the hydrazine compounds represented by aforesaid Formula H and at least one kind of the nucleation promoting compounds represented by aforesaid Formulas I through VI are contained. The content of the compounds represented by Formula H and Formulas I through VI are each preferably $5\times10^{-7}$ mols to $5\times10^{-1}$ mols, and especially preferably $5\times10^{-6}$ mols to $1\times10^{-2}$ mols per mol of the silver halide contained in the photographic light sensitive material.

The typical and concrete examples of the nucleation accelerating compounds will be given below.

N-1

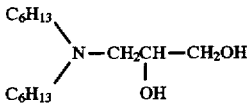

N-2

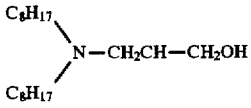

N-3

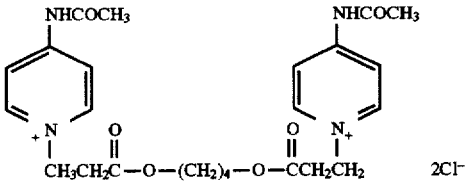

N-4

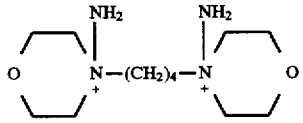

N-5

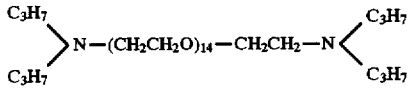

N-6

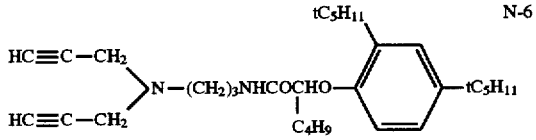

N-7

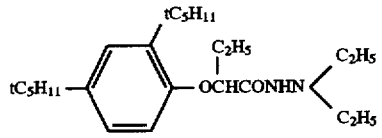

N-8

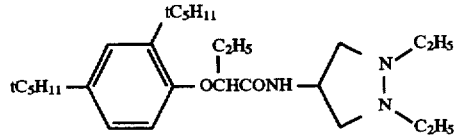

N-9

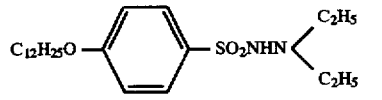

N-10

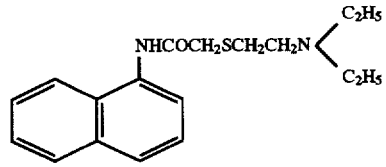

N-11

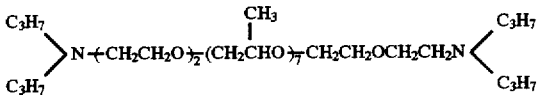

The other examples thereof are also given in the following examples of the nucleation accelerating compounds; namely; compounds I-1~I-26 each given in JP OPI Publication No. 4-98239/1992, p.(8); compounds II-1~II-29 each given in, ibid., pp.(9)~(10); compounds III-1~III-25 each given in, ibid., pp.(10)~(11); compounds IV-1~IV-41 each given in, ibid., pp.84~90; compounds V-I-1~V-I-27 each given in, ibid., pp.(11)~(13); compounds V-II-1~V-II-30 each given in, ibid., pp.(13)~(14); compound V-III-35 given in, ibid., p.(16); compounds VI-I-1~VI-I-44 each given in, ibid., pp.(18)~(20); compounds VI-II-1~VI-II-68 each given in, ibid., pp.(21)~(24); and compounds VI-III-1~VI-III-35 each given in, ibid., pp.(24)~(26).

Besides the compounds of the invention, the following additives may also be added to the developers of the invention. Namely, inorganic development inhibitors such as potassium bromide; organic development inhibitors such as 5-methylbenzotriazole, 5-methylbenzimidazole, 5-nitroindazole, adenine, guanine and 1-phenyl-5-mercaptotetrazole; metal-ion scavengers such as ethylenediamine tetraacetic acid; development accelerators such as methanol, ethanol, benzyl alcohol and polyalkylene oxide; surfactants such as sodium alkyl arylsulfonate, natural saponin, sugar and the alkyl esters of the foregoing compounds; layer hardeners such as glutar aldehyde, formalin and glyoxal; ionic strength controllers such as sodium sulfate; and so forth.

The developers applicable to the invention may also contain glycols such as diethylene glycol and triethylene glycol to serve as an organic solvent. It is however preferable that the developers may not contain any alkanolamines in such an amount that a hard contrast is provided.

In each of the silver halide emulsions applicable to the invention (hereinafter referred to as "a silver halide emulsion" or simply "an emulsion"), it is allowed to use arbitrary silver halides applicable to any common silver halide emulsions, for example, silver bromide, silver iodobromide, silver iodochloride, silver chlorobromide and silver chloride. Among these silver halides, silver chlorobromide, silver bromide, or silver iodobromide or silver iodochlorobromide each having a silver iodide content of not more than 2 mol % are preferable.

It is further preferable to use monodisperse type grains each having a variation coefficient of not more than 15%. The above-mentioned variation coefficient is represented by the following equation:

$$(\text{Standard deviation of grain size})/(\text{Average grain size})\times 100$$

The silver halide emulsions of the invention can be applied with a variety of techniques, additives and so forth which have been well-known in the art.

For example, the silver halide photographic emulsions and the backing layers each applicable to the invention can contain a variety of chemical sensitizers, color toners, layer hardeners, surfactants, thickeners, plasticizers, lubricants, development inhibitors, UV absorbents, anti-irradiation dyes, heavy metals, matting agents and so forth, in various methods. Further, the silver halide photographic emulsions and backing layers can also contain polymer latexes.

The above-mentioned additives are further detailed in Research Disclosure, Vol.176, Item/7643, December, 1978 and, ibid., Vol.187, Item/8716, November, 1979. The corresponding pages and columns thereto will be collectively given below.

| Kind of Additive | RD/7643 | RD/8716 |
|---|---|---|
| 1. Chemical sensitizer | p.23 | p.648, r.col. |
| 2. Sensitivity raiser | | " |
| 3. Spectral sensitizer | pp.23–24 | p.648, r.col. |
| Supersensitizer | | p.649, r.col. |
| 4. Whitening agent | p.24 | |
| 5. Antifoggant & stabilizer | pp.24–25 | p.649, r.col. |
| 6. Light absorbent, filter dye | pp.25–26 | p.649, r.col. |

-continued

| Kind of Additive | RD/7643 | RD/8716 |
|---|---|---|
| UV absorbent | | p.650, 1.col. |
| 7. Antistaining agent | p.25, r.col. | p.650, 1-r.cols. |
| 8. Dye image stabilizer | p.25 | |
| 9. Layer hardener | p.26 | p.651, 1.col. |
| 10. Binder | p.26 | " |
| 11. Plasticizer & lubricant | p.27 | p.650, r.col. |
| 12. Coating aid & surfactant | pp.26–27 | " |
| 13. Antistatic agent | p.27 | " |

The supports applicable to the silver halide photographic light-sensitive materials of the invention include, for example, those made of such a polyester as cellulose acetate, cellulose nitrate and polyethyleneterephthalate; those made of such a polyethylene as polyolefin; polystyrene; baryta paper; polyolefin-coated paper; glass plate; metal plate; and so forth. These supports may also be sub-treated if required.

EXAMPLES

Some concrete examples of the invention will be detailed below. However, the embodiments of the invention shall not be limited thereto.

Example 1

(Preparation of silver halide photographic emulsion A)

A silver iodobromide emulsion (having a silver iodide content of 0.7 mol % per mol of silver) was prepared in a double-jet precipitation process. In the process, $K_2IrCl_6$ was added in an amount of $8\times10^{-7}$ mols per mol of silver. The resulting emulsion was proved to be an emulsion comprising cubic-shaped monodisperse type grains having an average grain size of 0.20 μm (with a variation coefficient of 9%). After adding SD-1 in an amount of 8 mg/m$^2$ thereto, the resulting matter was washed with water and then desalted in ordinary methods. The resulting pAg thereof was 8.0 at 40° C. after completing the desalting treatment. Successively, an aqueous potassium iodide solution was added in an amount of 0.1 mol % per mol of silver into the resulting emulsion and the surfaces of the grains were each subjected to a conversion treatment. After that, the mixture of compounds (A), (B) and (C) was added and a sulfur sensitization was then applied thereto, so that emulsion A was prepared.

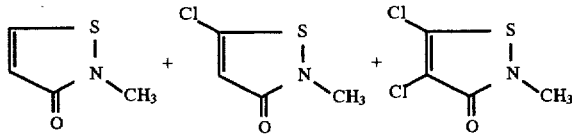

(A) + (B) + (C)

(Preparation of silver halide photographic light-sensitive material)

A 100μm-thick polyethylene terephthalate film was coated on both sides thereof respectively with 0.1 μm-thick sublayers (refer to Example 1 given in JP OPI Publication No. 59-19941/1984). Onto one of the sublayers, a silver halide emulsion layer having the following chemical prescription (1) was so coated as to have a gelatin content of 2.0 g/m$^2$ and a silver content of 3.2 g/m$^2$. Onto the emulsion layer, an emulsion protective layer having the following chemical prescription (2) was so coated as to have a gelatin content of 1.0 g/m$^2$. On to the other sublayer on the opposite side, a backing layer having the following chemical prescription (3) was so coated as to have a gelatin content of 2.4 g/m$^2$. Further, onto the backing layer, a backing protective layer having the following chemical prescription (4) was so coated as to have a gelatin content of 1 g/m$^2$. Resultingly, a sample was prepared.

Chemical prescription (1)
(Composition of silver halide emulsion layer)

| | |
|---|---|
| Gelatin | An amount to be 2.0 g/m$^2$ in an emulsion layer |
| Silver halide emulsion A | 3.2 g/m$^2$ in the silver content |
| Sensitizing dye: SD-1 | |

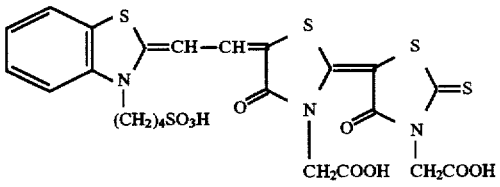

| | |
|---|---|
| Sensitizing dye: SD-2 | 1.0 mg/m$^2$ |

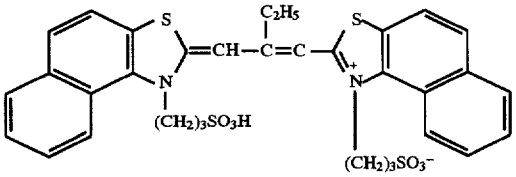

| | |
|---|---|
| Stabilizer: 4-methyl-6-hydroxy-1,3,3a,7-tetrazaindene | 30 mg/m$^2$ |

-continued

| | |
|---|---|
| Antifoggant: Adenine | 10 mg/m$^2$ |
| 1-phenyl-5-mercaptotetrazole | 5 mg/m$^2$ |
| Surfactant : Saponin | 0.1 g/m$^2$ |
| S-1 | 8 mg/m$^2$ |

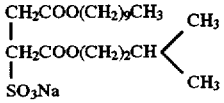

| | |
|---|---|
| Hydrazine derivative: C-7 | 25 mg/m$^2$ |
| C-8 | 2 mg/m$^2$ |
| Nucleation accelerator: N-10 | 2 mg/m$^2$ |
| N-11 | 20 mg/m$^2$ |
| Latex polymer: Lx-1 | 1 g/m$^2$ |

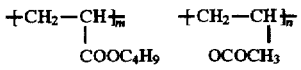

m:n = 50:50

| | |
|---|---|
| Polyethylene glycol, (having molecular weight of 4,000) | 0.1 g/m$^2$ |
| Hardener: H-1 | 60 mg/m$^2$ |

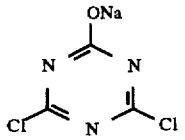

Chemical prescription (2)

[Composition of emulsion protective layer]

| | |
|---|---|
| Gelatin | 0.9 g/m$^2$ |
| Surfactant: S-2 | 10 g/m$^2$ |

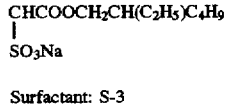

| | |
|---|---|
| Surfactant: S-3 | 5 mg/m$^2$ |

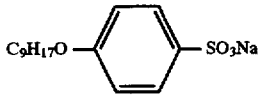

| | |
|---|---|
| Matting agent: Monodisperse type silica having an average particle size of 3.5 μm | 5 mg/m$^2$ |
| Hardener: 1,3-vinylsulfonyl-2-propanol | 40 mg/m$^2$ |

Chemical prescription (3)

(Composition of backing protective layer)

(a) 70 mg/m$^2$

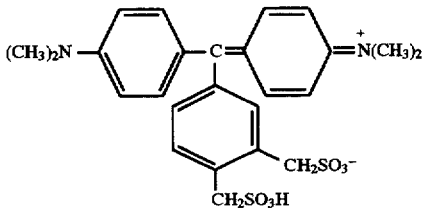

-continued (b)

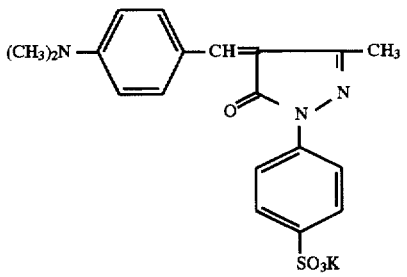

50 mg/m²

(c)

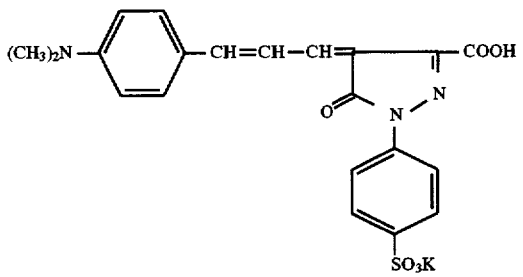

20 mg/m²

| | |
|---|---|
| Gelatin | 2.4 g/m² |
| Surfactant: Saponin | 0.1 g/m² |
| S-1 | 6 mg/m² |
| Colloidal silica | 100 mg/m² |
| Chemical prescription (4) | |
| [Composition of backing protective layer] | |
| Gelatin | 1 g/m² |
| Matting agent: Monodisperse type polymethyl methacrylate having an average particle size of 3.5 μm | 40 mg/m² |
| Surfactant: S-2 | 10 mg/m² |
| Layer hardener: Glyoxal | 25 mg/m² |
| H-1 | 35 mg/m² |

(Evaluation of silver sludge (silver contamination))

The resulting sample was exposed to an Ar laser beam for $10^{-6}$ seconds and the exposed sample was processed under condition described later with an automatic processor (manufactured by Konica Corp.) for rapid-processing use into which developer 1 and fixer having the composition described later are introduced, under the conditions of replenishing the developer in an amount of 160 cc and the fixer in an amount of 190 cc, each per $m^2$ of the sample.

The process that 200 film sheets each measuring 508×610 mm were developed under the above-mentioned conditions a day was repeated for three days. After that, an unexposed film sheet measuring 508×610 mm was developed through the automatic processor and the roller-streak like silver contamination appeared on the film surface was observed. On the other hand, after the development was made for three days in the same manner as mentioned above, the automatic processor is stopped in operation and, after 24 hours, black silver contamination produced in the developer tank of the automatic processor was observed. The evaluation was carried out as follows:

Rank 5: No silver contamination produced,

Rank 4: Faint silver contamination produced,

Rank 3: Slight silver contamination produced,

Rank 2: Silver contamination produced, and

Rank 1: Much silver contamination produced.

In the ranks lower than Rank 2, there is a problem in practical application.

(Evaluation of photographic characteristics)

The resulting sample was brought into close contact with a wedge and exposed to an Ar laser beam for $10^{-6}$ seconds. The exposed sample was then processed with an automatic processor for rapid processing use, Model GR-26SR manufactured by Konica Corp., into which developer and fixer were introduced under the following conditions, using the developer having the composition described later and standing ten days after prepared and the fixer having the composition described below.

The density of the resulting sample was measured through an optical densitometer, Konica Model PDA-65. The measured sensitivity of the sample was indicated by a sensitivity relative to the sensitivity of Sample No. 1 having a density of 2.5 which was regarded as a standard value of 100, and the gamma value of the sample was indicated by a tangent between the densities of 0.1 and 2.5. When the gamma value thereof was less than 8.0, the resulting contrast was not satisfactory, but were problematic for practical use.

(Evaluation of black spot)

Of the resulting processed samples, the unexposed areas thereof were each evaluated with the eye through a 40× magnifier. The samples having no black spot were evaluated as the highest rank '5' and graded as ranks '4', '3', '2' and '1' respectively from the second rank to the lowest rank in order of the black spot production. Those graded as ranks '2' and '1' were not on the practically satisfactory level.

(Composition of developer 1)

| | |
|---|---|
| Potassium sulfite | See Table 1 |
| Hydroquinone | 20.0 g |
| 4-methyl-4-hydroxymethyl-1-phenyl-3-pyrazolidone | 1.0 g |
| Disodium ethylenediamine tetraacetate | 2.0 g |
| Potassium carbonate | 12.0 g |
| Potassium bromide | 5.0 g |
| 5-methyl benzotriazole | 0.3 g |
| Diethylene glycol | 25.0 g |
| Compound of the invention having Formula (1) or (2) | See Table 1 |
| Add water to make | 1 liter |
| Adjust pH with potassium hydroxide to be | pH 10.7 |

Chemical formula of fixer

| | |
|---|---|
| Ammonium thiosulfate (in an aqueous 72.5% w/v solution) | 200 ml |
| Sodium sulfite | 17 g |
| Sodium acetate, trihydrate | 6.5 g |
| Boric acid | 6.0 g |

-continued

| | |
|---|---|
| Sodium citrate, dihydrate | 2.0 g |
| Pure water (ion-exchange water) | 17 ml |
| Sulfuric acid (in an aqueous 50% w/v solution) | 2.0 g |
| Aluminum sulfate (in an aqueous 8.1% w/v solution converted into an $Al_2O_3$ content) | 8.5 g |
| Before using the fixer, water added to make | 1 liter |
| Adjust pH with acetic acid to be | pH 4.8 |

(Processing condition)

Processing time included the cross-over time.

| (Processing step) | (Temperature) | (Time) |
|---|---|---|
| Developing | 38° C. | 12 sec. |
| Fixing | 35° C. | 10 sec. |
| Washing | 30° C. | 10 sec. |
| Drying | 50° C. | 13 sec. |
| | | Total:45 sec. |

The results thereof will be given in Table 1.

TABLE 1

| No. | Compound having Formula [1] or [2] Structure | Amount added, (mg/l) | $K_2SO_3$ concentration Amount added, (mol/l) | Silver sludge, (silver contamination), stains on film-surface | Silver sludge, (silver contamination), stains in Developer tank | Relative sensitivity | Gamma | Black spot | Remarks |
|---|---|---|---|---|---|---|---|---|---|
| 101 | — | — | 0.6 | 1 | 1 | 100 | 12 | 1 | Comparison |
| 102 | — | — | 0.2 | 2 | 2 | 95 | 12.5 | 2 | Comparison |
| 103 | Comparison A | 200 | 0.6 | 3 | 3 | 45 | 4.5 | 2 | Comparison |
| 104 | Comparison B | 200 | 0.6 | 3 | 3 | 50 | 4.5 | 2 | Comparison |
| 105 | Comparison C | 200 | 0.6 | 2 | 2 | 55 | 4 | 2 | Comparison |
| 106 | 1-6 | 200 | 0.2 | 5 | 5 | 65 | 6.5 | 3 | Comparison |
| 107 | 1-6 | 200 | 0.6 | 5 | 5 | 95 | 11.5 | 5 | Invention |
| 108 | 1-7 | 200 | 0.4 | 5 | 5 | 90 | 11 | 5 | Invention |
| 109 | 1-10 | 200 | 0.9 | 5 | 5 | 95 | 12 | 5 | Invention |
| 110 | 1-24 | 200 | 0.6 | 5 | 4 | 90 | 12 | 4 | Invention |
| 111 | 1-28 | 200 | 0.6 | 4 | 3 | 90 | 12 | 4 | Invention |
| 112 | 1-30 | 200 | 0.6 | 4 | 3 | 90 | 12 | 4 | Invention |
| 113 | 1-32 | 200 | 0.6 | 4 | 3 | 90 | 12 | 4 | Invention |
| 114 | 2-5 | 200 | 0.6 | 4 | 3 | 95 | 12 | 4 | Invention |
| 115 | 2-6 | 200 | 0.6 | 4 | 3 | 90 | 12 | 4 | Invention |
| 116 | 2-30 | 200 | 0.6 | 4 | 3 | 90 | 12 | 4 | Invention |
| 117 | 2-33 | 200 | 0.6 | 4 | 3 | 90 | 12 | 4 | Invention |

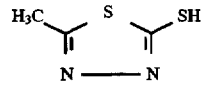

Comparison A

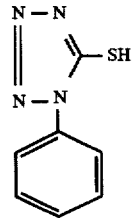

Comparison B

-continued

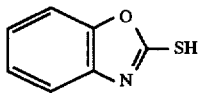

Comparison C

From the results shown in Table 1, it was proved that the samples of the invention produce no deterioration in both sensitivity and gamma and few silver sludge contamination, and inhibit any black spot production.

Example 2

(Emulsion preparation)

A silver nitrate solution and an aqueous solution containing sodium chloride, potassium bromide and rhodium hexachloride complex, in an amount of $8\times10^{-5}$ mols/mol of Ag were prepared. The resulting solutions were simultaneously added to a gelatin solution while controlling the flow rates of the two solutions and the mixture was desalted in an ordinary method. Thereby, a cubic, monodisperse type silver chlorobromide emulsion having an average grain size of 0.13 μm and a silver bromide content of 1 mol % could be obtained.

The resulting emulsion was sulfur-sensitized in an ordinary method and, thereto, 6-methyl-4-hydroxy-1,3,3a,7-tetrazaindene was added as a stabilizer. After that, the following additives were added to prepared an emulsion-coating solution. Next, an emulsion-protective layer coating solution, a backing layer coating solution and a backing layer-protective layer coating solution were each prepared so as to have the following compositions.

| | |
|---|---|
| (Preparation of emulsion coating solution) | |
| Silver halide emulsion | An amount to have a silver content of 3.0 g/m$^2$ |
| Gelatin | An amount to provide an emulsion coating solution in an amount of 1.2 g/m$^2$ |
| Hydrazine derivative of the invention (c-1) | 10 mg/m$^2$ |
| Hydrazine derivative of the invention (c-8) | 7.5 mg/m$^2$ |
| Nucleation accelerator (N-10) | 20 mg/m$^2$ |
| Compound (a) | 7.5 mg/m$^2$ |
| Saponin (in an aqueous 20% solution) | 0.5 cc/m$^2$ |
| 5-nitroindazole | 10 mg/m$^2$ |
| Hydroquinone | 50 mg/m$^2$ |
| 1-phenyl-5-mercaptotetrazole | 5 mg/m$^2$ |
| Latex Lx-2 | 0.8 g/m$^2$ |
| A styrene-maleic acid copolymer, (a thickener) | 90 mg/m$^2$ |
| (Emulsion-protective layer coating solution) | |
| Gelatin | 0.7 g/m$^2$ |
| Compound (b) | 40 mg/m$^2$ |
| Compound (c) | 100 mg/m$^2$ |
| Compound (d) | 100 mg/m$^2$ |
| Globular-shaped monodisperse type silica, (having a particle size of 8 μm) | 20 mg/m$^2$ |
| Globular-shaped monodisperse type silica, (having a particle size of 3 μm) | 10 mg/m$^2$ |
| Surfactant S-3 (The same as in Example 1) | 5 mg/m$^2$ |
| Citric acid | Adjusted to have pH 5.8 |
| LX-2 | 0.8 g/m$^2$ |
| A styrene-maleic acid copolymer, (a thickener) | 50 mg/m$^2$ |
| Layer hardener (H-2) | 10 mg/m$^2$ |
| (Backing layer coating solution) | |
| Gelatin | 1.4 g/m$^2$ |
| Compound (f) | 80 mg/m$^2$ |
| Compound (c) | 15 mg/m$^2$ |
| Compound (g) | 150 mg/m$^2$ |
| Saponin (in an aqueous 20% solution) | 0.6 cc/m$^2$ |
| Latex (Lx-1) (The same as in Example 1) | 300 mg/m$^2$ |
| 5-methylbenzotriazole | 5 mg/m$^2$ |
| 5-nitroindazole | 20 mg/m$^2$ |
| A styrene-maleic acid copolymer, (a thickener) | 50 mg/m$^2$ |
| Layer hardener H-1 | 10 mg/m$^2$ |
| (Backing protective layer coating solution) | |
| Gelatin | 1.0 g/m$^2$ |
| Compound (f) | 40 mg/m$^2$ |

-continued
| | |
|---|---|
| Compound (c) | 100 mg/m$^2$ |
| Compound (g) | 100 mg/m$^2$ |
| Surfactant S-3 (The same as in Example 1) | 5 mg/m$^2$ |
| Globular-shaped polymethyl methacrylate, (having a particle size of 4 μm) | 25 mg/m$^2$ |
| Layer hardener, glyoxal | 10 mg/m$^2$ |
Compound (a)
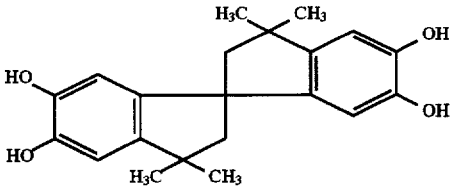
Compound (b)
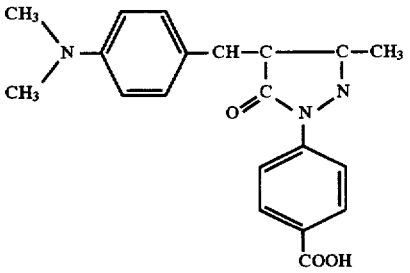
(Solid disperse type dye)
Compound (d)
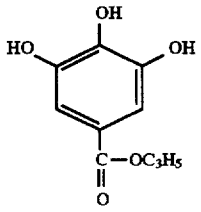
H-2
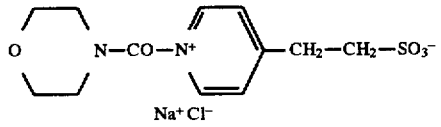
(f)
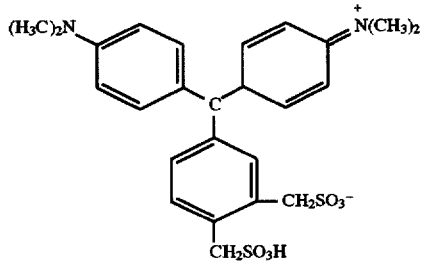

-continued (c)

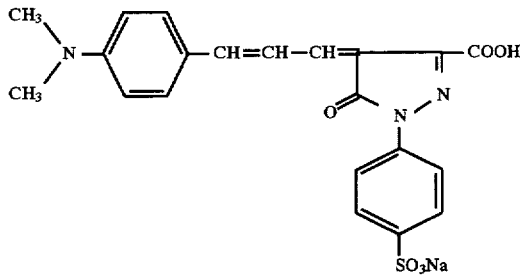

(g)

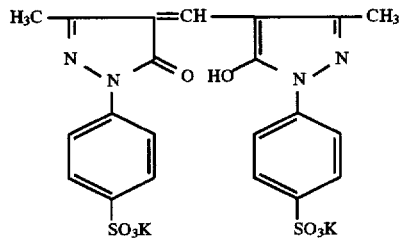

(Latex Lx-2)

In an nitrogen atmosphere, a mixed solution of (i) 3.0 Kg of styrene, (ii) 3.0 Kg of methyl methacrylate and (iii) 3.2 Kg of ethyl acrylate and 0.8 Kg of sodium 2-acrylamido-2-methylpropane sulfonate were each added into a mixture solution containing 60 liters of water, 1.0 Kg of gelatin, 0.01 Kg of sodium dodecylbenzene sulfonate and 0.05 Kg of ammonium persulfate by taking one hour while stirring them at a solution temperature of 60° C. After that, the resulting solution was further stirred for another 1.5 hours and then vapor distilled for one hour so that the remaining monomers were removed. After they were cooled down to room temperature and the pH thereof was adjusted to be 6.0 by making use of ammonia. The resulting latex solution was finished by adding water to make 75 Kg. In the above-mentioned manner, a monodisperse type latex having an average particle size of 0.1 μm was prepared.

Each of the resulting coating solutions was multicoated on a 100 μm-thick subbed polyethylene terephthalate support so as to provide a backing layer and a backing protective layer on the back side in this order from the position closer to the support, and they were dried up. Next, the coating solutions were each multicoated on the support so as to provide an emulsion layer and an emulsion protective layer on the surface of the support opposite the backing layer side in this order from the position closer to the support and they were dried up.

The resulting samples were each evaluated in the same manner as in Example 1, except that they samples were each processed with the following developer 2. The results thereof will be given in Table 2.

| (Composition of developer 2) | |
|---|---|
| Potassium sulfite | See Table 2 |
| Hydroquinone | 25.0 g |
| N-methyl-p-aminophenol-1/2-sulfate | 0.8 g |
| Disodium ethylenediamine tetraacetate | 1.0 g |
| Sodium carbonate | 13.5 g |
| L-sodium ascorbate | 1.0 g |
| Potassium bromide | 6.0 g |
| 5-methylbenzotriazole | 0.4 g |
| Diethyleneglycol | 25.0 g |
| Compound of the invention | |
| having Formula (1) or (2) | See Table 2 |
| Add water to make | 1 liter |
| Adjust pH with potassiun hydroxide to be | 10.3. |

TABLE 2

| No. | Compound having Formula [1] or [2] Structure | Amount added, (mg/l) | $K_2SO_3$ concentration Amount added, (mol/l) | Silver sludge, (silver contamination), stains on film-surface | Silver sludge, (silver contamination), stains in Developer tank | Relative sensitivity | Gamma | Black spot | Remarks |
|---|---|---|---|---|---|---|---|---|---|
| 201 | — | — | 0.6 | 1 | 1 | 100 | 10.5 | 1 | Comparison |
| 202 | — | — | 0.2 | 2 | 2 | 90 | 10.5 | 1 | Comparison |
| 203 | Comparison A | 200 | 0.6 | 3 | 3 | 50 | 3.5 | 1 | Comparison |

TABLE 2-continued

| No. | Compound having Formula [1] or [2] Structure | Amount added, (mg/l) | $K_2SO_3$ concentration Amount added, (mol/l) | Silver sludge, (silver contamination), stains on film-surface | Silver sludge, (silver contamination), stains in Developer tank | Relative sensitivity | Gamma | Black spot | Remarks |
|---|---|---|---|---|---|---|---|---|---|
| 204 | Comparison B | 200 | 0.6 | 3 | 3 | 45 | 3.5 | 1 | Comparison |
| 205 | Comparison C | 200 | 0.6 | 2 | 2 | 50 | 3 | 1 | Comparison |
| 206 | 1-6 | 200 | 0.2 | 5 | 5 | 65 | 6 | 2 | Comparison |
| 207 | 1-6 | 200 | 0.6 | 5 | 5 | 95 | 10 | 4 | Invention |
| 208 | 1-8 | 200 | 1.0 | 5 | 5 | 90 | 9.5 | 4 | Invention |
| 209 | 1-10 | 200 | 0.4 | 5 | 5 | 95 | 10 | 4 | Invention |
| 210 | 1-20 | 200 | 0.6 | 5 | 5 | 95 | 10 | 4 | Invention |
| 211 | 1-24 | 200 | 0.6 | 5 | 4 | 90 | 10 | 4 | Invention |
| 212 | 1-28 | 200 | 0.6 | 4 | 3 | 90 | 10 | 3 | Invention |
| 213 | 1-30 | 200 | 0.6 | 4 | 3 | 90 | 10 | 3 | Invention |
| 214 | 1-32 | 200 | 0.6 | 4 | 3 | 90 | 10 | 3 | Invention |
| 215 | 2-5 | 200 | 0.6 | 4 | 3 | 95 | 10 | 4 | Invention |
| 216 | 2-6 | 200 | 0.6 | 4 | 3 | 90 | 10 | 4 | Invention |
| 217 | 2-30 | 200 | 0.6 | 4 | 3 | 90 | 10 | 4 | Invention |
| 218 | 2-33 | 200 | 0.6 | 4 | 3 | 90 | 10 | 4 | Invention |

From the results shown in Table 2, it was proved that the samples of the invention displayed the excellent results in every item same as in Example 1.

What is claimed is:

1. A method of processing an imagewise exposed black and white silver halide photographic light-sensitive material, said method comprising:

wherein $R_1$ and $R_2$ each individually represent alkyl, alkenyl, alkinyl, aryl or a heterocycle ; $R_3$ represents hydrogen, alkyl, alkenyl, alkinyl, aryl, a heterocycle , acyl, sulfonyl, oxycarbonyl or carbamoyl; and $R_4$ represents a group containing at least one group represented by $$-(CH_2-\underset{\underset{|}{}}{\overset{\overset{R}{|}}{C}}H-X)_n-R^2 \text{ or } -(CH_2-\underset{\underset{Y}{|}}{CH}-CH_2-O)_nR^1,$$

is hydrogen or alkyl, wherein R represents hydrogen, or alkyl, X represents O S, or NH, Y represents hydrogen or OH, and n is an integer of not less than 2, provided that $R_1$, $R_2$, $R_3$ and $R_4$ may combine with each other to form a ring, Formula VI-II

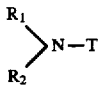

wherein $R_1$ and $R_2$ each individually represent hydrogen, alkyl, alkenyl, alkinyl, aryl or a heterocycle, provided that $R_1$ and $R_2$ may combine to form a ring; T represents a group containing Formula V-III

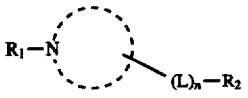

wherein $R_1$ represents hydrogen, alkyl, alkenyl, alkinyl, aryl or a heterocycle; $R_2$ represents alkyl, alkenyl, alkinyl, aryl or a heterocycle

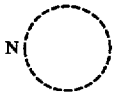

represents a nitrogen-containing heterocyclic ring, provided that $R_1$ may form a ring together with

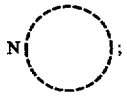

L represents —$CONR_4$—, —$OCONR_4$—, —$NR_4CONR_4$—, —$NR_4COO$—, —COO—, —OCO—, —CO—, —OCOO—, —$NR_4CO$—, —$SO_2NR_4$, —$NR_4SO_2$—, —$NR_4SO_2NR_4$—, —$SO_2$—, —S—, —O—, —$NR_4$—, or —N= group with the proviso that, when L is —N=, two $R_3$ groups can be present; wherein $R_4$ represents hydrogen or alkyl; and n is an integer of 0 or 1;

Formula VI-I

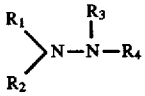

wherein $R_1$, $R_2$ and $R_3$ each individually represent alkyl, alkenyl, alkinyl, aryl or a heterocycle, provided that at least one of $R_1$, $R_2$ and $R_3$ represent alkenyl or alkinyl, or at least one of $R_1$ and $R_2$ represents aryl or a heterocycle; and L represents —A—Y— wherein A represents alkylene, and Y represents —$CONR_4$—, —$OCONR_4$—, —$NR_4CONR_4$—, —$NR_4COO$—, —COO—, —OCO—, —CO—, —OCOO—, —$NR_4CO$—, —$SO_2NR_4$—, —$NR_4SO_2$—, —$NR_4SO_2NR_4$—, —$SO_2$—, —S—, —O—, —$NR_4$— or —N= group with the proviso that when Y is —N=, two $R_3$ groups are bonded thereto, wherein $R_4$represents hydrogen or alkyl, provided that $R_1$, $R_2$, $R_3$ and L may combine to form a ring;

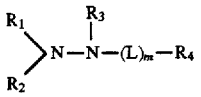

Formula V-II wherein $R_1$, $R_2$, and $R_4$ each individually represent alkyl, alkenyl, alkinyl, aryl or a heterocycle; and $R_3$ represents hydrogen, alkyl, alkenyl, alkinyl, aryl or a heterocycle ; L represents —CO—, —COO—, —$CONR_5$—, —$SO_2$—, and —$SO_2NR_5$— wherein $R_5$ represents hydrogen, alkyl, alkenyl, aryl or a heterocycle; and m is an integer of 0 or 1, provided that $R_1$, $R_2$, $R_3$ and $R_4$ may combine with each other to form a ring;

wherein $R_1$ and $R_2$ each individually represent alkyl, provided that $R_1$ and $R_2$ may combine with each other to form a ring; $R_3$ represents alkyl, aryl or a heterocycle; A represents alkylene; and Y represents —$CONR_4$—, —$OCONR_4$—, —$NR_4CONR_4$—, —$NR_4COO$—, —COO—, —OCO—, —CO—, —OCOO—, —$NR_4CO$—, —$SO_2NR_4$—, —$NR_4SO_2$—, —$NR_4SO_2NR_4$—, —$SO_2$—, —S—, —O—, —$NR_4$—, or —N= group wherein $R_4$ represents hydrogen or alkyl with the proviso that, when Y is —N=, two $R_3$ groups are bonded thereto;

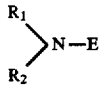

Formula IV wherein $R_1$ and $R_2$ each individually represent hydrogen, alkyl, alkenyl, alkinyl, aryl or a heterocycle; and E represents a group having at least one group represented by —$(CH_2CH_2O)_n$R' is hydrogen or alkyl and n is an integer of 2 or more, provided that $R_1$, $R_2$ and E may combine to form a ring;

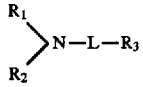

Formula V-I wherein $R_1$, $R_2$, and $R_3$ each individually represent hydrogen, alkyl, alkenyl, alkinyl, aryl or a heterocycle, provided that $R_1$, $R_2$, and $R_3$ may combine with each other to form a ring and $R_1$, $R_2$, and $R_3$ are not simultaneously hydrogen;

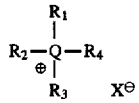

Formula II wherein Q represents N or P; $R_1$ $R_2$, $R_3$ and $R_4$ each represent hydrogen, alkyl, alkenyl, alkinyl, aryl, a heterocycle or amino; and X⊖ represents an anion, provided that $R_1$, $R_2$, $R_3$ and $R_4$ may combine with each other to form a ring;

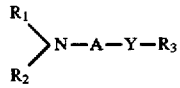

Formula III developing said material with a developer replenished with a developer replenisher in an amount of not more than 200 ml/$m^2$ of material processed, wherein said material comprises a support having provided thereon a silver halide photographic emulsion layer and a hydrophilic colloid layer other than said emulsion layer, at least one of said emulsion layer and said hydrophilic colloid layer containing a hydrazine derivative and at least one compound selected from a compound represented by a formula selected from the group consisting of Formulas I to IV, V-I to V-III, and VI-I to VI-III, wherein said developer has a pH of 10.0 to 11.2, and comprises (a) a dihydroxybenzene compound, (b) at least one of a 3-pyrazolidone compound and an aminophenol compound, (c) 0.3 to 1.2 mol per liter of a sulfite, and (d) at least one compound represented by Formula (1) to (2)

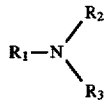

Formula I at least one group represented by

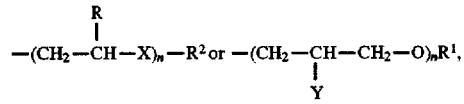

$R^1$ is hydrogen or alkyl, wherein R represents hydrogen or alkyl, X represents O, S or NH, Y represents hydrogen or OH, and n is an integer of not less than 2, provided that, when R represents hydrogen, X represents S or NH group,

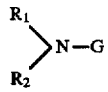

Formula VI-III wherein $R_1$ and $R_2$ each individually represent hydrogen, alkyl, alkenyl, alkinyl, aryl, or a heterocycle, provided that $R_1$ and $R_2$ may combine to form a ring; and G represents a group containing at least one group represented by —$(CH_2CH_2O)_n$ -R' wherein n is an integer of not less than 2 and R' is hydrogen or alkyl, containing at least two substituents each selected from the group consisting of —CN, —OH, —$OSO_2CH_3$, —$SO_2N(CH_2)_2$, —$NHCOCH_3$, and

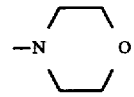

or a group containing at least one substituent selected from the group consisting of —$CONH_2$, —CONHOH, —$CONHCH_3$, —$NH_2$, —$NHCONH_2$,—$NHCSNH_2$, —$NHSO_2CH_3$, —$N^+(CH_3)_3$, —$O^-$, —$O^-$, —$OCONH_2$, —$SO_3^-$, —$SO_2NH_2$, —$SOCH_3$, —$SO_2CH_3$ and —$COO^{31}$;

Z—SM

Formula (1)

wherein Z represents alkyl, aryl or a heterocyclic group, each having a group selected from the group consisting of hydroxy, —$SO_3M^1$, —$COOM^1$, unsubstituted amino or acetylamino and unsubstituted ammonio or methyl, ethyl, benzyl, ethoxypropyl, cyclohexyl, phenyl, or naphthylammonio wherein $M^1$ represents a hydrogen, an alkali metal or an unsubstituted ammonium ion; and M represents hydrogen, alkali metal or an unsubstituted amidino which may form a hydrogen halogenide or sulfonate salt.

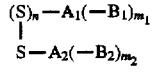

Formula (2)

wherein $A_1$ and $A_2$ each independently represent an aliphatic group, an alicyclic group, aralkyl, aryl, or 5 or 6-membered heterocycle; c and d each independently represent an integer of 1, 2, or 3; n represents an integer of 1 or 2; and $B_1$ and $B_2$ independently represent —COOM', —$SO_3$M', —CON(X) (Y), —S—Z' or —$SO_2$N(X) (Y) wherein X and Y each represent hydrogen or alkyl having 1 to 8 carbons, or aryl; M' represents a monovalent cation; and Z' represents alkyl having 1 to 8 carbon atoms, or aryl.

2. The method of claim 1, wherein the total processing time is within the range of 20 to 60 seconds.

3. The method of claim 1, wherein said developer contains the dihydroxy benzene compound in an amount of 0.05 to 1.5 mol/liter and the 3-pyrazolidone compound in an amount of not more than 0.2 mol/liter.

4. The method of claim 1, wherein said developer contains the dihydroxy benzene compound in an amount of 0.05 to 1.5 mol/liter and the aminophenol compound in an amount of not more than 0.2 mol/liter.

5. The method of claim 1, wherein said developer contains at least one of the compounds represented by said Formulae (1) and (2) in an amount of 0.1 to 10 mmol/liter.

6. The method of claim 1, wherein said developer has a pH value of 10.0 to 10.9.

7. The method of claim 1, wherein said developer has a pH value of 10.0 to 10.7.

8. The method of claim 1, wherein said developing comprises supplying replenisher for developer in an amount of 75 to 200 ml per $m^2$ of the material.

9. The method of claim 1, wherein at least one layer of said emulsion layer and said hydrophilic colloid layer contains the hydrazine derivative in an amount of $1\times10^{-6}$ to $1\times10^{-1}$ mol per mol of silver.

10. The method of claim 1, wherein said hydrazine derivative includes a compound represented by the following Formula (H-c) or Formula (H-d):

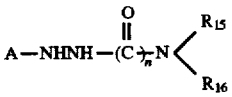

Formula (H-c)

wherein A represents an aryl group or a heterocyclic group containing at least one of a sulfur and oxygen atom; n represents an integer of 1 or 2; and when n is 1, $R_{15}$ and $R_{16}$ independently represent a hydrogen atom, an alkyl group, an alkenyl group, an alkinyl group, an aryl group, a heterocyclic group, a hydroxy group, an alkoxy group, an alkenyloxy group, an alkinyloxy group, an aryloxy group or a heterocyclicoxy group or $R_{15}$ and $R_{16}$ may form a ring together with a nitrogen atom; and when n is 2, $R_{15}$ and $R_{16}$ independently represent a hydrogen atom, an alkyl group, an alkenyl group, an alkinyl group, an aryl group, a heterocyclic group, a hydroxy group, an alkoxy group, an alkenyloxy group, an alkinyloxy group, an aryloxy group or a heterocyclicoxy group, provided that at least one of $R_{15}$ and $R_{16}$ represents an alkenyl group, an alkinyl group, a saturated heterocyclic group, a hydroxy group, an alkoxy group, an alkenyloxy group, an alkinyloxy group, an aryloxy group or a heterocyclicoxy group.

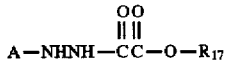

Formula (H-d)

wherein A is defined as above $R_{17}$ represents an alkyl group, an alkenyl group, an aryl group, an alkinyl group or a heterocyclic group.

11. The method of claim 1, wherein said hydrazine derivative includes a compound represented by the following Formula (H-c):

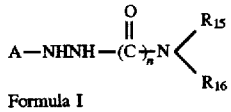

Formula (H-c)

Formula I wherein A represents an aryl group or a heterocyclic group containing at least one of a sulfur and oxygen atom; n represents an integer of 1 or 2; and when n is 1, $R_{15}$ and $R_{16}$ independently represent a hydrogen atom, an alkyl group, an alkenyl group, an alkinyl group, an aryl group, a heterocyclic group, a hydroxy group, an alkoxy group, an alkenyloxy group, an alkinyloxy group, an aryloxy group or a heterocyclicoxy group or $R_{15}$ and $R_{16}$ may form a ring together with a nitrogen atom; and when n is 2, $R_{15}$ and $R_{16}$ independently represent a hydrogen atom, an alkyl group, an alkenyl group, an alkinyl group, an aryl group, a heterocyclic group, a hydroxy group, an alkoxy group, an alkenyloxy group, an alkinyloxy group, an aryloxy group or a heterocyclicoxy group, provided that at least one of $R_{15}$ and $R_{16}$ represents an alkenyl group, an alkinyl group, a saturated heterocyclic group, a hydroxy group, an alkoxy group, an alkenyloxy group, an alkinyloxy group, an aryloxy group or a heterocyclicoxy group.

12. The method of claim 1 wherein said compound represented by Formula (1) is represented by the following Formula (1-b):

Formula (1-b)

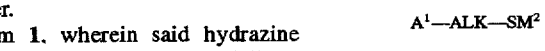

wherein $A^1$ represents hydroxy, —$SO_3M^1$, —$COOM^1$, in which $M^1$ represents hydrogen, alkali metal or unsubstituted ammonium ion, or —$N(R^3)_2$ group in which $R^3$ represents unsubstituted alkyl having 1 to 5 carbons, provided that a ring may be formed by linking the two $R^3$ groups to each other; ALK represents unsubstituted alkylene or alkylene having methyl or ethyl as a substituent; and $M^2$ represents hydrogen or the following group

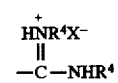

wherein $R^4$ represents hydrogen, or unsubstituted phenyl having not more than 10 carbons, and $X^-$ represents halide ion, sulfonic acid ion, or —S—ALK—$A^1$.

13. The method of claim 1 wherein said hydrazine derivative is represented by the following Formula (H):

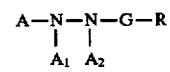

Formula (H)

wherein A represents aryl, or a heterocycle containing at least one sulfur or oxygen; G represents

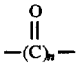

sulfonyl, sulfoxy,

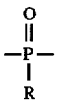

or amino methylene; n is an integer of 1 or 2; $A_1$ and $A_2$ each represent hydrogen, or one of $A_1$ and $A_2$ represents hydrogen, and the other represents unsubstituted alkyl sulfonyl or acyl; and R represents hydrogen, alkyl, aryl, alkoxy, aryloxy, amino, carbamoyl, oxycarbonyl, or —O—$R_2$, in which $R_2$ represents alkyl or a saturated heterocycle.

14. The method of claim 1 wherein said compound represented by Formula (1) is represented by Formula (1-c)

$A^1$—Ar—SM wherein $A^1$ represents a hydroxy group, —$SO_3M^1$, in which $M^1$ represents hydrogen, alkali metal, or unsubstituted ammonium ion, or —$N(R^3)_2$ in which $R^3$ represents unsubstituted alkyl having 1 to 5 carbons, provided that a ring may be formed by linking each of the $R^3$ groups to each other; Ar represents aryl; and M represents hydrogen, alkali metal, or unsubstituted amidino which may form hydrogen halogenide or sulfonate salt.

15. The method of claim 1 wherein said compound represented by Formula (2) is represented by Formula (2-a)

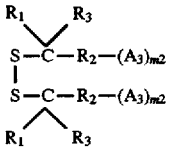

wherein $R_1$ and $R_3$ each represent hydrogen, alkyl having 1 to 6 carbons, alkinyl, arylalkyl, cycloalkyl, phenyl, a 5 or 6-membered heterocyclic ring containing nitrogen, oxygen, or sulfur; $R_2$ represents a direct bond, alkylene, alkylidene, phenylene, arylalkylene or —$CONHCH_2$; $A_3$ represents —COOM or —$SO_3M$, in which M represents hydrogen, alkali metal, unsubstituted ammonium ion; and m2 is an integer of 1 or 2.

16. The method of claim 1 wherein said compound represented by Formula (2) is represented by the following Formula (2-b):

Formula (2-b

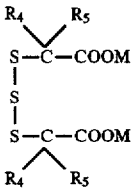

wherein $R_4$ and $R_5$ each represent hydrogen or methyl; and M represents hydrogen cation or alkali metal ion.

17. The method of claim 1 wherein said compound represented by Formula (1) is represented by the following Formula (1-a):

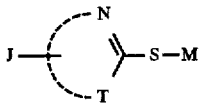

wherein T represents an atomic group necessary to form a 5-membered heterocyclic ring; J represents hydroxy, unsubstituted amino, unsubstituted ammonio, alkyl having 1 to 19 carbons —$S_3M^1$ or —$COOM^1$ in which $M^1$ represents hydrogen, alkali metal, or unsubstituted ammonium ion; and M represents hydrogen, alkali metal, or unsubstituted amidino which may form hydrogen halogenide or sulfonate salt

* * * * *